US009591413B2

(12) United States Patent
Miller

(10) Patent No.: US 9,591,413 B2
(45) Date of Patent: Mar. 7, 2017

(54) HYDRAULIC MICROPHONE

(71) Applicant: Cochlear Limited, Macquarie University, NSW (AU)

(72) Inventor: Scott Allen Miller, Lafayette, CO (US)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 14/533,610

(22) Filed: Nov. 5, 2014

(65) Prior Publication Data

US 2015/0126805 A1 May 7, 2015

Related U.S. Application Data

(60) Provisional application No. 61/900,790, filed on Nov. 6, 2013.

(51) Int. Cl.

| | |
|---|---|
| ***H04R 25/00*** | (2006.01) |
| ***H04R 21/02*** | (2006.01) |
| ***H04R 1/44*** | (2006.01) |
| ***H04R 1/08*** | (2006.01) |

(52) U.S. Cl.

CPC ..... *H04R 25/606* (2013.01); *H04R 1/086* (2013.01); *H04R 1/44* (2013.01); *H04R 21/028* (2013.01); *H04R 25/604* (2013.01); *H04R 25/608* (2013.01); *H04R 2225/31* (2013.01); *H04R 2225/67* (2013.01); *H04R 2460/13* (2013.01); *Y10T 29/49005* (2015.01)

(58) Field of Classification Search

CPC .... H04R 25/606; H04R 25/604; H04R 1/086; H04R 2460/13; H04R 2225/31; H04R 2225/67

See application file for complete search history.

(56) References Cited

U.S. PATENT DOCUMENTS

| | | | | |
|---|---|---|---|---|
| 6,707,920 | B2 | 3/2004 | Miller | |
| 7,840,020 | B1 * | 11/2010 | Miller, III | H04R 25/604 381/326 |
| 2009/0281366 | A1 * | 11/2009 | Basinger | H04R 25/606 600/25 |
| 2010/0092021 | A1 * | 4/2010 | Wiskerke | H04R 1/08 381/364 |
| 2013/0289655 | A1 * | 10/2013 | Einberger | H04R 25/606 607/57 |

* cited by examiner

*Primary Examiner* — Tuan D Nguyen
(74) *Attorney, Agent, or Firm* — Hauptman Ham, LLP

(57) ABSTRACT

A device, including an implantable microphone, including a chamber in which media corresponding to at least one of a liquid or a fluid resistant to compression is located such that vibrations originating external to the microphone are effectively transmitted through the media.

23 Claims, 18 Drawing Sheets

HYDRAULIC MICROPHONE

CROSS-REFERENCE TO RELATED APPLICATIONS

This application claims priority to Provisional U.S. Patent Application No. 61/900,790, entitled Hydraulic Microphone, filed on Nov. 6, 2013, naming Scott Allen Miller of Colorado, USA, as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is a device, comprising an implantable microphone, including a chamber in which media corresponding to at least one of a liquid or a fluid resistant to compression is located such that vibrations originating external to the microphone are effectively transmitted through the media.

In accordance with another aspect, there is a device, comprising an implantable microphone, including an electret transducer having a back volume; and a bounded volume extending from a component that moves in response to vibration originating from exterior to the microphone to a location at least proximate the transducer, wherein the bounded volume has a volume of at least about one-half that of a back volume of the transducer, and physical attenuation of energy traveling through the bounded volume, resulting from vibrations impinging upon the component that moves, that is transduced by the transducer, is less than about three dB.

In accordance with another aspect, there is a device, comprising an implantable microphone, including a chamber at least substantially full of a mass at least generally conforming to boundaries thereof, a transducer having a first component in volumetric communication with the mass, wherein the implantable microphone is configured such that the mass is restrained from coming into touching contacting with the first component.

In accordance with another aspect, there is a method, comprising obtaining a housing of an implantable microphone, inserting non-gaseous matter into a volume bounded at least in part by walls of the housing such that the volume is at least substantially filled and trapping the non-gaseous matter in the volume, such that the non-gaseous matter transfers vibrational energy through the volume such that a transducer located proximate the volume effectively receives the transferred vibrational energy.

BRIEF DESCRIPTION OF THE DRAWINGS

Some embodiments are described below with reference to the attached drawings, in which.

DETAILED DESCRIPTION

Figure 1:
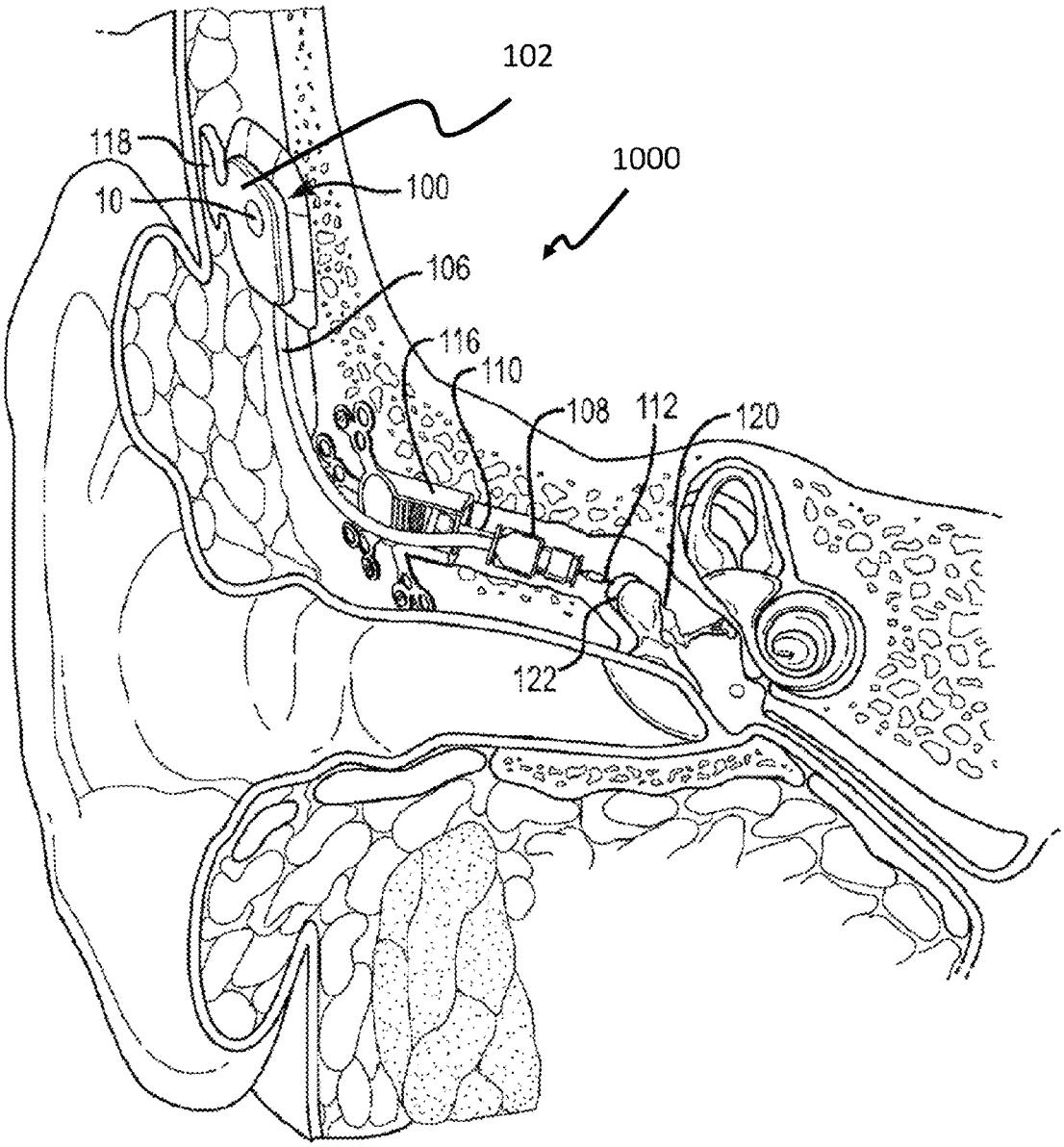
FIG. 1 is a perspective view of an exemplary hearing prosthesis in which at least some embodiments can be implemented.

FIG. 1 depicts an exemplary hearing prosthesis in which the teachings detailed herein and/or variations thereof can be utilized, which corresponds to a totally (or fully) implantable hearing prosthesis. FIG. 1 depicts a totally implantable direct acoustic cochlear implant (DACI) 1000, which includes an implantable unit 100 which can include a housing 102 in which receiver coils are located or with which receiver coils 118 are in communication, located subcutaneously on or at least partially in a recipient's skull. The implantable unit 100 can include an energy storage device (not shown), a microphone 10, and a signal processor (not shown) including a speech signal-processing (SSP) unit (i.e., in addition to processing circuitry and/or a microprocessor). Various additional processing logic and/or circuitry components may also be included in the implantable unit 100.

The signal processor is electrically interconnected via wire 106 to an electromechanical transducer 108. The transducer 108 is supportably connected to a positioning system 110, which in turn, is connected to a bone anchor 116 mounted within the patient's mastoid bone (e.g., via a hole drilled through the skull). The transducer 108 includes a connection apparatus 112 for connecting the transducer 108 to the ossicles 120 of the recipient. In a connected state, the connection apparatus 112 provides a communication path for acoustic stimulation of the ossicles 120, e.g., transmission of axial vibrations to the incus 122.

It is noted that in an alternate embodiment, the teachings detailed herein and/or variations thereof are applied in a cochlear implant, in which instance, by way of example, unit 100 can correspond to a receiver-stimulator thereof. In an alternate embodiment, the teachings detailed herein and/or variations thereof are applied in a bone conduction device, such as, for example, an active transcutaneous bone conduction device. In such an exemplary embodiment, unit 100 can correspond to an implantable component of such a device. In yet an alternate embodiment, the teachings detailed herein and/or variations thereof are applied in a hearing prosthesis in which two or more of such prostheses are implanted in the recipient. The teachings detailed herein and/or variations thereof can be applicable to any type of prosthesis in which the teachings detailed herein and/or variations thereof can have utilitarian value.

During normal operation, vibrations originating from an ambient noise resulting in acoustic signals impinging upon skin of the recipient are received subcutaneously at the microphone 10. The microphone 10 converts these signals to outputs (e.g., electrical outputs, optical outputs, etc.) which are provided to the implanted sound processor which processes the signals (e.g., using a speech sound processor unit) to provide a processed audio drive signal via wire 106 to the transducer 108. The audio drive signals cause the transducer 108 to transmit vibrations at acoustic frequencies to the connection apparatus 112 to affect a utilitarian hearing percept via mechanical stimulation of the incus 122 of the patient. In alternate embodiments, the microphone 10 outputs signals to a sound processor of a cochlear implant and/or a sound processor of a bone conduction device and/or to a sound processor of whatever prosthesis the teachings detailed herein and/or variations thereof have utilitarian value.

An external charger (not shown) can be utilized to transcutaneously re-charge the energy storage device within the unit 100. Such an external charger can include a power source and a transmitter that is operative to transcutaneously transmit, for example, RF signals to the implanted receiver 118. In this regard, the implanted receiver 118 can also include, for example, rectifying circuitry to convert a received signal into an electrical signal for use in charging the energy storage device. The external transmitter and implanted receiver 118 can comprise coils for inductive coupling of signals there between. In addition to being inductively coupled with the inductive coil 118 for charging purposes, such an external charger can also provide program instructions to the processor(s) of the implantable hearing instrument.

Figure 2:
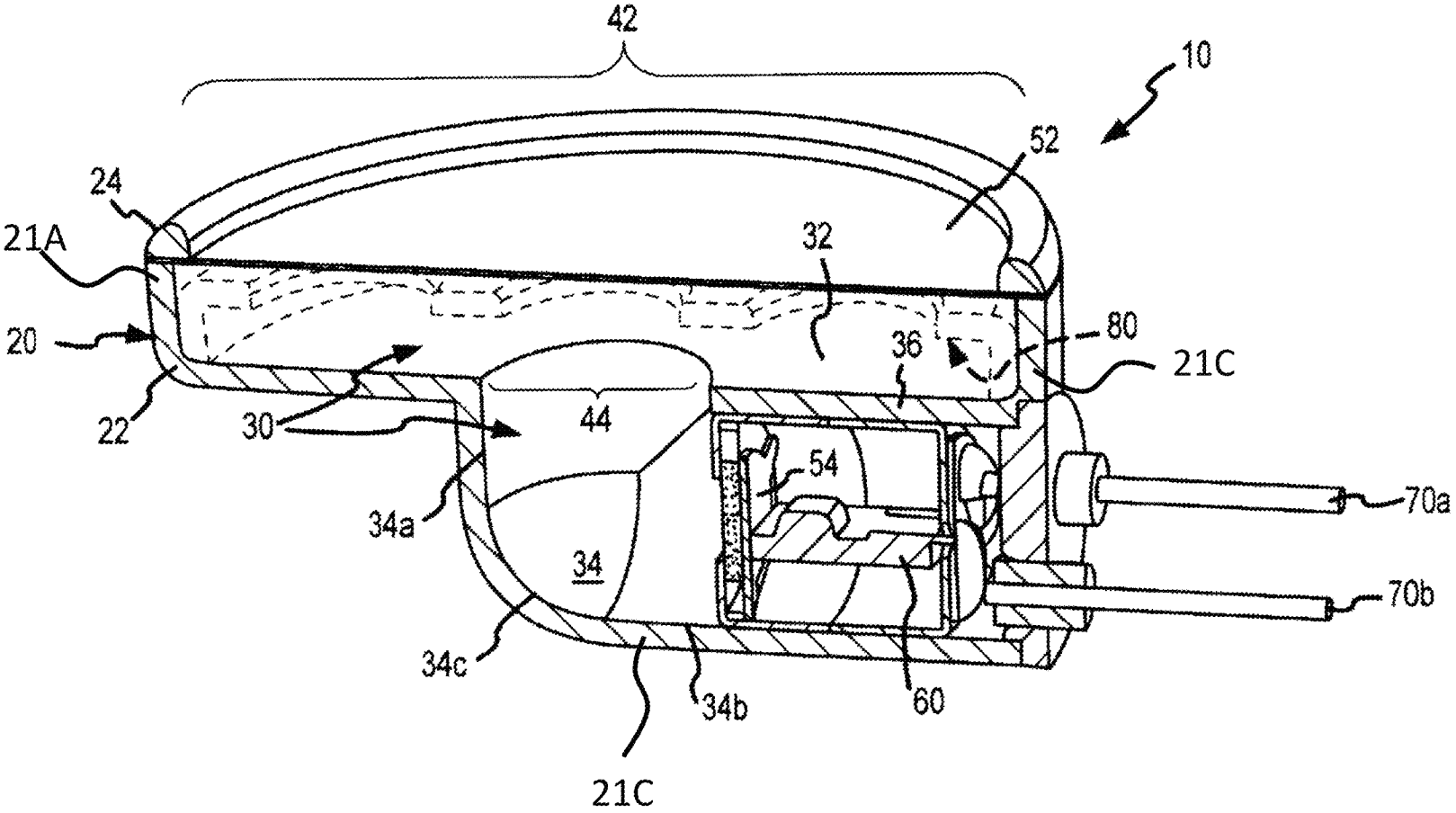
FIG. 2 is an isometric, cross-sectional view of an implantable microphone in which at least some teachings detailed herein can be implemented.

FIG. 2 depicts a cross-sectional view of the microphone 10. The microphone 10 includes a housing 20 that defines an internal chamber 30. The chamber 30 has an aperture 42 across which a first diaphragm 52 is sealably disposed. Housing 20 includes a base member 22 and a peripheral member 24 defining the aperture 42. The peripheral edge of the first diaphragm 52 is fixedly interconnected between the base member 22 and peripheral member 24 of the housing 20 (e.g., via laser welding). The peripheral member 24 and the diaphragm 52 are the two components of the microphone 10 that can be seen in FIG. 1.

In this regard, microphone 10 is located in the unit 100 such that the diaphragm 52 is at least about on the same plane as the top surface of the unit 10, although in an alternate embodiment, the microphone 10 is located such that the diaphragm 52 is proud of that top surface is parallel thereto or recessed relative to that top surface and parallel thereto, although in alternative embodiments of the diaphragm 52 is canted relative to that top surface. In an exemplary embodiment, the outside of the housing 20 is welded to the top surface of the unit 10 at a location at least at about a portion of the housing below the peripheral member 42 and the diaphragm 52 if such extends all the way to the outside of the housing 20. This weld can establish a hermetic seal between the exposed portions of the microphone 10 and the top surface of the unit 100 such that the interior the unit 100 is hermetically sealed from the ambient environment. In an exemplary embodiment, at least some, if not at least substantially all of the microphone 10 below the diaphragm 52 is located below the top surface of the unit 100, and thus inside the unit 100 (and thus inside a hermetically enclosed environment).

It is further noted that in alternative embodiments, the microphone 10 can be located within the recipient at a location remote from unit 100. That is, in an exemplary embodiment, microphone 10 can be a separate, self-contained unit in signal communication with unit 100, where the latter contains the signal processor and/or other components, the microphone 10 being in signal communication with unit 100 via electrical leads, etc. In such an exemplary embodiment, additional housing components might be utilized with microphone 10 to achieve the functionality afforded by the unit 100 with respect to hermetically enclosing portions of the microphone 10 that might not be hermetically enclosed according to the configuration of FIG. 2 (although in other embodiments, the configuration of FIG. 2 presents a hermetic enclosure with respect to the at least the components establishing the outline of the microphone 10 presented therein—where communication cables 10*a* and 10*b* (discussed further below) can lead to feedthroughs hermetically connected to the housing 20 and/or can be hermetically sealed at junctions passing into the housing, the microphone element 60). Any implanted placement of the microphone 10 that can enable the microphone 10 to be utilitarianly utilized according to the teachings detailed herein and or variations thereof can be utilized in at least some embodiments Referring now to FIG. 3A, the first diaphragm 52 is recessed relative to the outer peripheral member 24. In this regard, in at least some exemplary embodiments there is utilitarian value if the first diaphragm 52 is recessed a distance t relative to the outer rim of peripheral member 24. In an exemplary embodiment, t is greater than 0.5 mm and/or less than 1.0 mm.

Figure 3A:
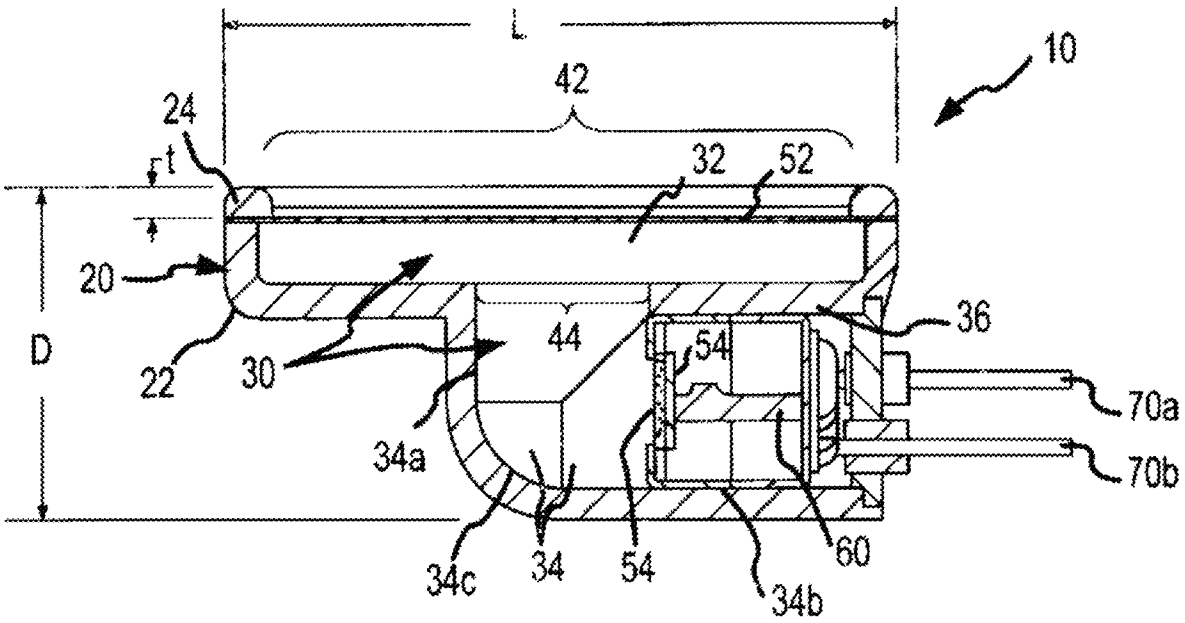
FIGS. 3A and 3B are cross-sectional and top views, respectively, of the device of FIG. 2.

As illustrated in FIGS. 2 and 3A, internal chamber 30 can be provided to include a first portion 32 and a second portion 34. The first portion 32 is disposed adjacent to the first diaphragm 52. The second portion 34 adjoins and extends away from the first portion 32 at an opening 44 therebetween and about an axis that is transverse to the first diaphragm 52 and aperture 42. As shown, opening 44 can be of a reduced cross-sectional area relative to aperture 42.

In the microphone 10, the second internal chamber portion 34 10 be of L-shaped configuration, wherein the second portion 34 comprises a first leg 34*a* that extends away from the first internal chamber portion 32 about an axis that is substantially perpendicular to a center plane of the first diaphragm 52. The second internal chamber portion 34 further includes a second leg 34*b* interconnected to the first leg 34*a* at a rounded elbow 34*c*.

Aperture 42 and opening 44 can each be of a circular configuration and can each be aligned about a common center axis. Correspondingly, such common center axis can be aligned with a center axis for first diaphragm 52 which can also be of a circular shape. Further, the first internal chamber portion 32 and first leg 34*a* of the second internal chamber portion 34 can each be of a cylindrical configuration, and can each be aligned on the same center axis as aperture 42 and opening 44. The second leg 34*b* of the second portion 34 of chamber 32 can be disposed to extend substantially perpendicularly from the first leg 34*a* of the second portion 34. As such, it can be seen that the second leg 34*b* may share a wall portion 36 with the first portion 32 of the internal chamber 30.

As shown in FIGS. 2 and 3A, the above-noted second diaphragm 54 is disposed at the interface between the first leg 34*a* and second leg 34*b* of the second chamber portion 34. More particularly, the second diaphragm 54 can be provided at a port of a conventional hearing aid (corresponding to microphone element 60) which is disposed within the second leg 34*b* of the second chamber portion 34. In this regard, microphone element 60 can comprise an electret transducer in the form of an electret condenser microphone. In this regard, the second diaphragm 54 can be provided as part of the conventional hearing aid microphone. Microphone element 60 can be provided with electrical power and control signals and may provide an electrical output signal, each of which signals are carried by corresponding signal lines 70*a*, 70*b* or 70*c*.

In use, the microphone 10 can be surgically implanted in the mastoid region of a patient, wherein the aperture 42 and the first diaphragm 52 are positioned immediately adjacent to and facing the skin of the patient. Upon receipt of vibrations traveling through the skin of the recipient resulting from an acoustical signal impinging upon the outside of the recipient's skin as a result of an ambient noise, first diaphragm 52 will vibrate to act upon the enclosed volume within chamber 30 and thereby pass the vibration from one side of the first diaphragm 52 (the outside) into the chamber 30 such that it is communicated by the medium therein and received by the second diaphragm 54.

Upon receipt of vibrational energy traveling through internal chamber 30 originating from movement of the diaphragm 52 and impinging upon the second diaphragm 54, the microphone element 60 converts the energy impinging thereupon into an electrical signal for output via one of the signal lines 70*a*, 70*b* or 70*c*. In turn, such output signal can be further conditioned and/or directly transmitted to a sound processor or the like of the hearing prosthesis of which the microphone 10 is apart.

The housing 20 and first diaphragm 52 can be constructed from biocompatible materials. In particular, titanium and/or biocompatible titanium-containing alloys may be utilized for the construction of such components. With particular respect to the first diaphragm 52 in an exemplary embodiment, the material utilized and thickness thereof can be such that it yields resonant frequency above about 3.5 kHz when mechanically loaded by tissue, wherein the resonance has, in at least some embodiments no greater than about a 20 dB excursion. Further, attenuation effects of the first diaphragm 52 can be, in at least some embodiments, more than 10 dB from about 250 Hz to 5.5 kHz. By way of example, first diaphragm 52 can comprise titanium, and may be of a flat, disk-shaped configuration having a thickness of between about 5 to about 20 microns. In an exemplary embodiment, there is a diaphragm having a 10 or 15 micron thickness that is under tension of about 400 N/m. However, in an alternate embodiment, the first diaphragm 52 is instead a plate, such as a titanium plate, having a thickness of more than 20 microns. In an exemplary embodiment, the diaphragm (or plate) has a material utilized and thickness thereof is such that it yields resonant frequency above about 9, 10, 11, 12, 13, 14, 15 or more kHz when mechanically loaded by tissue. In an exemplary embodiment, when element 52 is a plate, the plate can have a thickness of less than or equal to about 200 microns (in some embodiments, there is no tension on the plates). In an exemplary embodiment, there is a plate having a thickness of about 100 microns or less, or a plate having a thickness of about 32 microns or less. In an exemplary embodiment, the spring rate of the diaphragm is relatively small compared to the spring rate of the fluid inside the chamber. This results in the pressure loading being coupled to the microphone diaphragm in a relatively complete manner, rather than some of the force from the external pressure being supported by the diaphragm 52 and the housing 20 whereby the pressure loading can be lost.d In an exemplary embodiment, there is a support member 80 that is located within the first portion 32 of the internal chamber 30 of housing 20, as is depicted by the phantom lines in FIG. 2.

In an exemplary embodiment, media corresponding to a liquid and/or a fluid resistant to compression (e.g., an incompressible fluid) is located in the internal chamber 30. The media is located such that vibrations originating external to the microphone 10 that impinge onto diaphragm 52 and resulting energy being transmitted through the diaphragm 52 and thus into the internal chamber 30 are effectively transmitted through the media. The microphone element 60 is configured to transduce the transmitted energy (vibrations) into output signals indicative of the vibrations originating external the microphone 10. In this regard, microphone element 60 (transducer 60) is in effective vibrational communication with the media. In an exemplary embodiment, transducer 60, corresponding to the transducer noted above, operates in at least about the same manner (including the same manner) as it would operate if the internal chamber 30 was filled with a compressible gas, such as an ideal gas, although the output of the microphone element 60 can be substantially improved relative to that, as will be described herein further below.

Exemplary media can correspond to the following, providing that the media enables the teachings detailed herein and/or variations thereof to be practiced: oil, saline solutions, silicone gels, silicone oils, water, alcohol, etc. Other media can be utilized in alternate embodiments.

With respect to embodiments in which a liquid and/or a fluid resistant to compression is located in the internal chamber 30, in an exemplary embodiment, the internal chamber 30 is at least substantially full of (including full of) the liquid and/or fluid. In this regard, in an exemplary embodiment, almost no (including no) compressible gas is located within chamber 30 (this can be achieved via a degassing operation—discussed further below). In some embodiments, there can also be included solids within the internal chamber 30. Indeed, in an exemplary embodiment, the chamber 30 includes liquid and/or a fluid resistant to compression and solids, wherein, in at least some embodiments, the solids are secured or otherwise in fixed relationship to the interior of the internal chamber 30.

By effectively transmitted, it is meant, that vibrations, such as vibrations resulting from vibrations impinging upon the diaphragm 52 that have traveled through skin of the recipient as a result of ambient noise, are transmitted through the medium such that any damping and/or attenuation that takes place due to the medium does not render the vibrations unusable to transduce a signal therefrom, the signal being usable by a sound processor or the like to develop a signal to control a hearing prosthesis to evoke a meaningful hearing percept.

In an exemplary embodiment, the medium has the following exemplary characteristics. A material with a very low attenuation, such as water or silicone gel, will introduce little attenuation to the resonant peak, whereas a material selected for damping, such as silicone gel loaded with glass beads, can introduce larger attenuation. An exemplary embodiment includes a material having an attenuation that is tuned (and thus includes a method of tuning the material) by the relative density and size of the loading material from essentially nothing to that of a very lossy material. It should be noted, however, that the minimum attenuation of the microphone as a system can, in some embodiments, be limited by the losses of the tissue loading the outer surface.

It is noted that any liquid that can enable the teachings detailed herein and/or variations thereof to be practiced can be utilized in at least some embodiments. In an exemplary embodiment, the liquid is alcohol and/or alcohol in a combination with another liquid. Biologically compatible oils can be used in at least some embodiments. It is further noted that a gel is encompassed within the meaning of liquid, even though it behaves at least somewhat like a solid.

Any fluid that is resistant to compression and can enable the teachings detailed herein and/or variations thereof, such as by way of example a substantially incompressible fluid (which includes an incompressible fluid), can be utilized in at least some embodiments. By resistant to compression, it is meant any fluid that has compressibility features that substantially differentiate the fluid from, for example, those of an ideal gas at one atmosphere and at 98.6° F.

Additional performance and configuration features of some exemplary embodiments are described below. First, however, an alternate embodiment is described.

Figure 4:
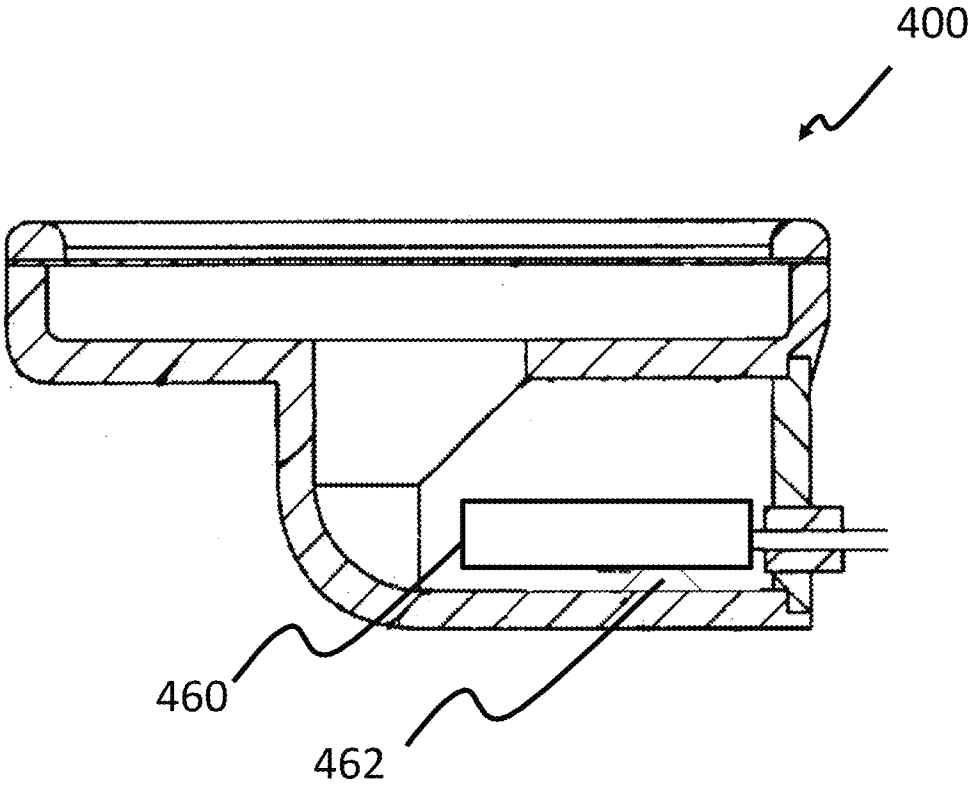
FIG. 4 is an alternate embodiment.

Referring now to FIG. 4, in an exemplary embodiment, there is a microphone 400 corresponding to the teachings detailed herein and/or variations thereof, with the exception that the transducer is a hydrophone 460 located in chamber 30. Such an exemplary embodiment, in at least some instances can have utilitarian value by at least substantially filling chamber 30 with a liquid. In an exemplary embodiment, the hydrophone 460 utilizes one or more piezoelectric elements to transduce energy traveling through the liquid resulting from movement of the diaphragm 52 into a signal that can be utilized by a sound processor.

In an alternate embodiment, two or transducers can be utilized to provide redundancy and/or performance selectability. In an exemplary embodiment utilizing two transducers, one transducer is a hydrophone 460 and the other transducer is the microphone element 60, although placement of the hydrophone 460 can be different from that depicted in FIG. 4 in exemplary embodiments where the transducer 60 corresponds in design configuration emplacement with respect to that of FIG. 2. By way of example only and not by way of limitation, scenarios can exist where the hydrophone 460 transduces vibrations traveling through the medium in a manner such that the output of the hydrophone 460 provides a signal that is more utilitarian with respect to evoking a hearing percept utilizing a hearing prosthesis based on that signal as compared to the signal outputted by microphone element 60. Alternate scenarios can exist where the opposite is the case. In an exemplary embodiment, a control system can evaluate the signals output by the hydrophone 460 and/or the microphone 60 and determine which one will provide a more utilitarian signal for use by the hearing prosthesis, if only for a specific scenario, and control the hearing prosthesis (or at least control the transmittal of signals) such that the hearing prosthesis evokes a hearing percept based on the signal from the hydrophone 460 instead of the microphone 60, or vice versa. In an alternate embodiment, the signals can be combined, in an equal or weighted manner. Of course, in some embodiments, the hydrophone/microphone combination provides redundancy, such that in the event that one of the hydrophone or microphone fails, the other is present such that use of the hearing prosthesis as a totally implantable system can continue without explanting the unit 100 in general and/or the microphone 10/400 in particular to repair or replace the microphone.

Still with reference to FIG. 4, it can be seen that the hydrophone 460 is supported by support structure 462 such that the hydrophone 460 is fixedly mounted to the housing 20 of the microphone 400. In alternate embodiments, the placement of the hydrophone 460 can be located at other locations, such as for example within the L-shaped corridor or on element 36 of the housing such that the microphone element 60 can be located in the chamber 30 as depicted in FIG. 2. In alternate embodiments, the microphone element 60 can be located in other locations.

Briefly, some exemplary configurations of the hydrophone 460 are hydrophones that utilize one, two or more piezoelectric disks that are deformed as a result of receipt of vibrational energy thereon. In an exemplary embodiment, the "back volume" of the hydrophone is relatively small, if existence at all (ramifications of a relatively small "back volume," which includes no back volume, are described in greater detail below). In an exemplary embodiment, the acoustic impedance of the hydrophone 460 is substantially similar to, which includes the same as, the acoustic impedance of the medium or media inside the chamber 30.

It is noted at this time that some embodiments can utilize a single media filling internal chamber 30, while in other embodiments two or more media are used to fill the chamber. Accordingly, with respect to the teachings of this specification, reference to the singular includes the plural and vice versa unless otherwise explicitly noted.

Figure 3B:
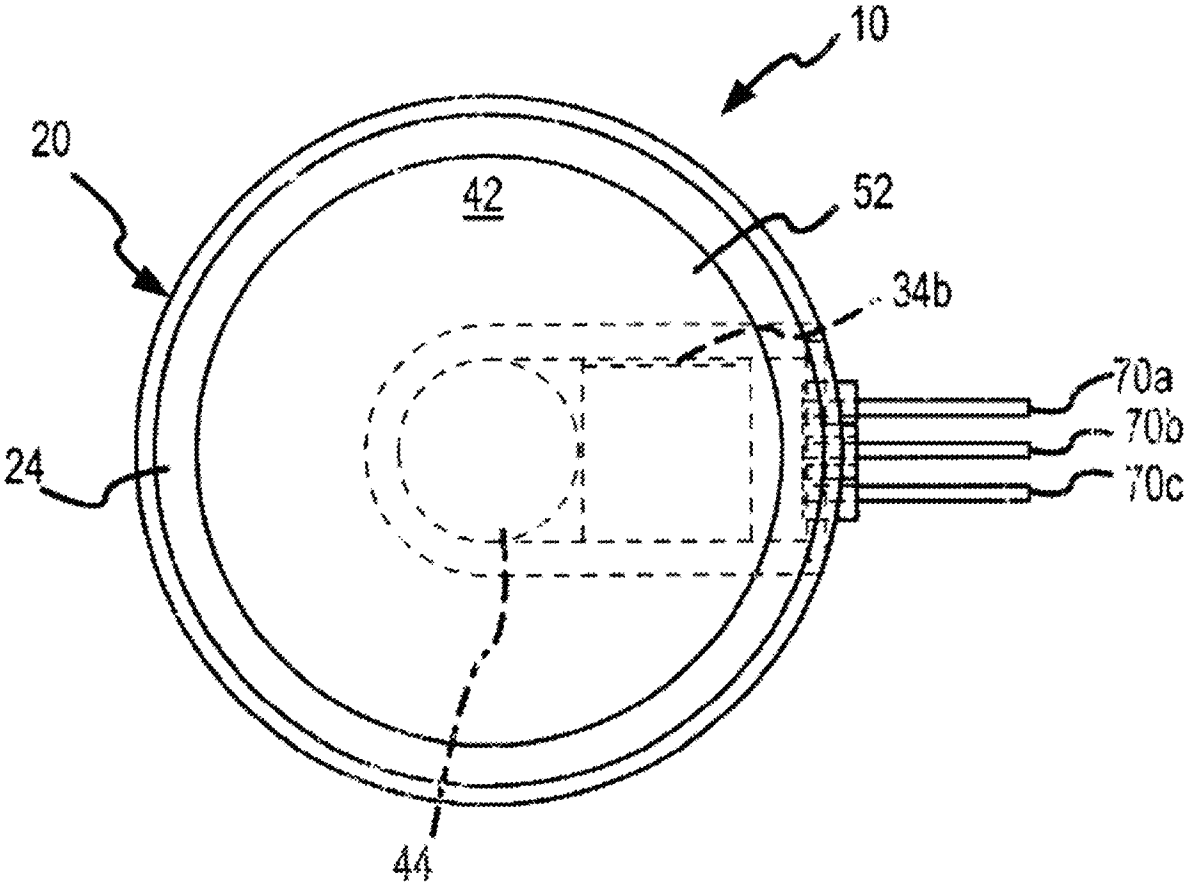
Figure 5A:
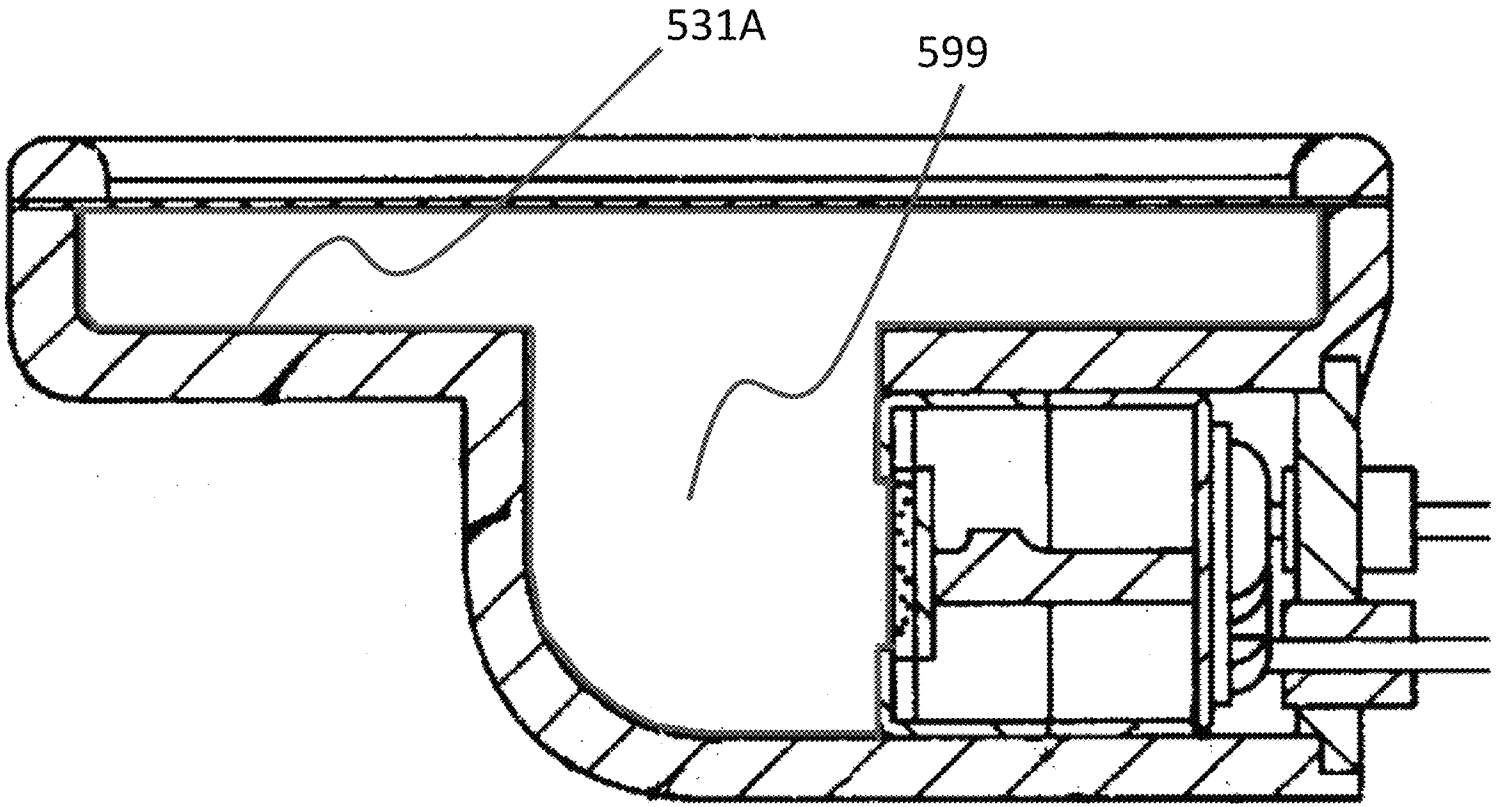
FIGS. 5A and 5B are cross-sectional views presenting a concept of respective embodiments.

Still referring to FIGS. 2-4, chamber 30 corresponds to a bounded volume. A perimeter of a cross-section 531 of this bounded volume is seen in FIG. 5A, which corresponds to the view of FIG. 3A. The bounded volume extends from diaphragm 52 (a component that moves in response to vibration originating from exterior to the microphone 10/400) to a location at least proximate the microphone element 60 (i.e., proximate the second diaphragm 54). In some embodiments, the bounded volume 559 extends to the microphone element 60 (the second diaphragm 54), while in other embodiments the bounded volume 555 does not extend all the way to the microphone element 60, as is exemplary depicted in FIG. 5B. In an exemplary embodiment, the bounded volume extends to a location D1 within about 1 mm, about 0.75 mm, 0.5 mm, 0.25 mm or less or any value or range of values therebetween in 0.01 mm increments (e.g., about 0.46 mm, about 0.28 mm, about 0.4 mm to about 0.09 mm, etc.) of the second diaphragm 54. Additional details about the bounded volume, including structure that limits the volume from extending to the second diaphragm 54, are described below. First, however, some performance parameters associated with the bounded volume will now be described.

In an exemplary embodiment, the bounded volume has a volume of at least about one-half that of a back volume of the microphone element 60, although in some embodiments, the ratio of the bounded volume to back volume is about 0.3, 0.4, 0.5, 0.6, 0.7, 0.8, 0.9, 1.0, 1.1, 1.2, 1.3, 1.4, or about 1.5 or more or any values or range of values therebetween in 0.01 increments (about 0.58, about 0.75, about 0.3 to about 0.88, etc.). In an exemplary embodiment, the back volume of the transducer is at least about 2 $mm^3$, 3, 4, 5, 6, 7, 8, 9, 10, 11, 12, 13, 14, 15 $mm^3$ or more or any value or range of values therebetween in 0.01 $mm^3$ increments (e.g., about 6.44 $mm^3$, about 7.83 $mm^3$, about 5.00 $mm^3$ to about 10.04 $mm^3$, etc.).

In an exemplary embodiment having one or more of the aforementioned front and back volume relationships and/or volumes, physical attenuation of energy traveling through the bounded volume, resulting from vibrations impinging upon the component that moves (diaphragm 52), that is transduced by the microphone element 60, is less than about three dB In an exemplary embodiment, the attenuation is less than about 2.0 dB, 1.5, 1.0, 0.75, 0.5, 0.4, 0.3, 0.2, 0.1 dB or less or any value or range of values therebetween in 0.05 dB increments (e.g., about 0.455 dB, about 0.765 dB, 0.30 to about 1.95 dB, ect.).

In an exemplary embodiment, the physical attenuation is less than about 2, 3, 4, 5, 6, 7, 8, 9, 10, 11, 12, 13, 14, 15 times or more than that which would be the case if the internal chamber 30 was full or at least substantially full of a fluid not resistant to compression, such as by way of example only and not by way of limitation, an ideal gas at one atmosphere at 98.6° F.

In an exemplary embodiment, the output signal of the microphone element 60 is more than about 2, 3, 4, 5, 6, 7, 8, 9, 10, 11, 12, 13, 14, 15 times or more than that which would be the case if the internal chamber 30 was full or at least substantially full of a fluid not resistant to compression, such as by way of example only and not by way of limitation, an ideal gas at one atmosphere at 70° F.

Exemplary embodiments can have utility with respect to preventing contact of the medium with the microphone element 60 in general, and in particular the diaphragm 54 of the microphone element 60 in particular, at least with respect to instances where the medium is a liquid. In this regard, in an exemplary embodiment, the diaphragm 54 of the microphone element 60 can include a through hole that extends from the front of the microphone element 60 into the internal chamber of the microphone element 60. In an exemplary embodiment, this through hole prevents the inside of microphone element 60 from being hermetically sealed relative to the outside of microphone 60. This through hole has utility in that it enables pressure variation within the microphone element 60 example, inward displacement of the diaphragm 54 does not result in a pressure build up with in the microphone element 60 that creates resistance to movement of the diaphragm 54. Alternatively and/or in addition to this, the diaphragm 54 of the microphone element 60 can comprise an electret surface, where utilitarian value of that electric surface can be lessened if the surface is wetted by the medium or otherwise comes into contact with the medium. Accordingly, at least some embodiments are directed towards the concept of FIG. 5B, where the bounded volume represented by boundary 530B is full of or at least substantially full of a liquid, and the bounded volume does not extend all the way to the microphone element 60/diaphragm 54. In an exemplary embodiment, such a configuration can prevents or otherwise limit the likelihood of a liquid or the like passing through the hole in diaphragm 54, and thus entering the microphone element 60, which in some embodiments can result in a deleterious effect on the microphone element 60.

Figure 5B:
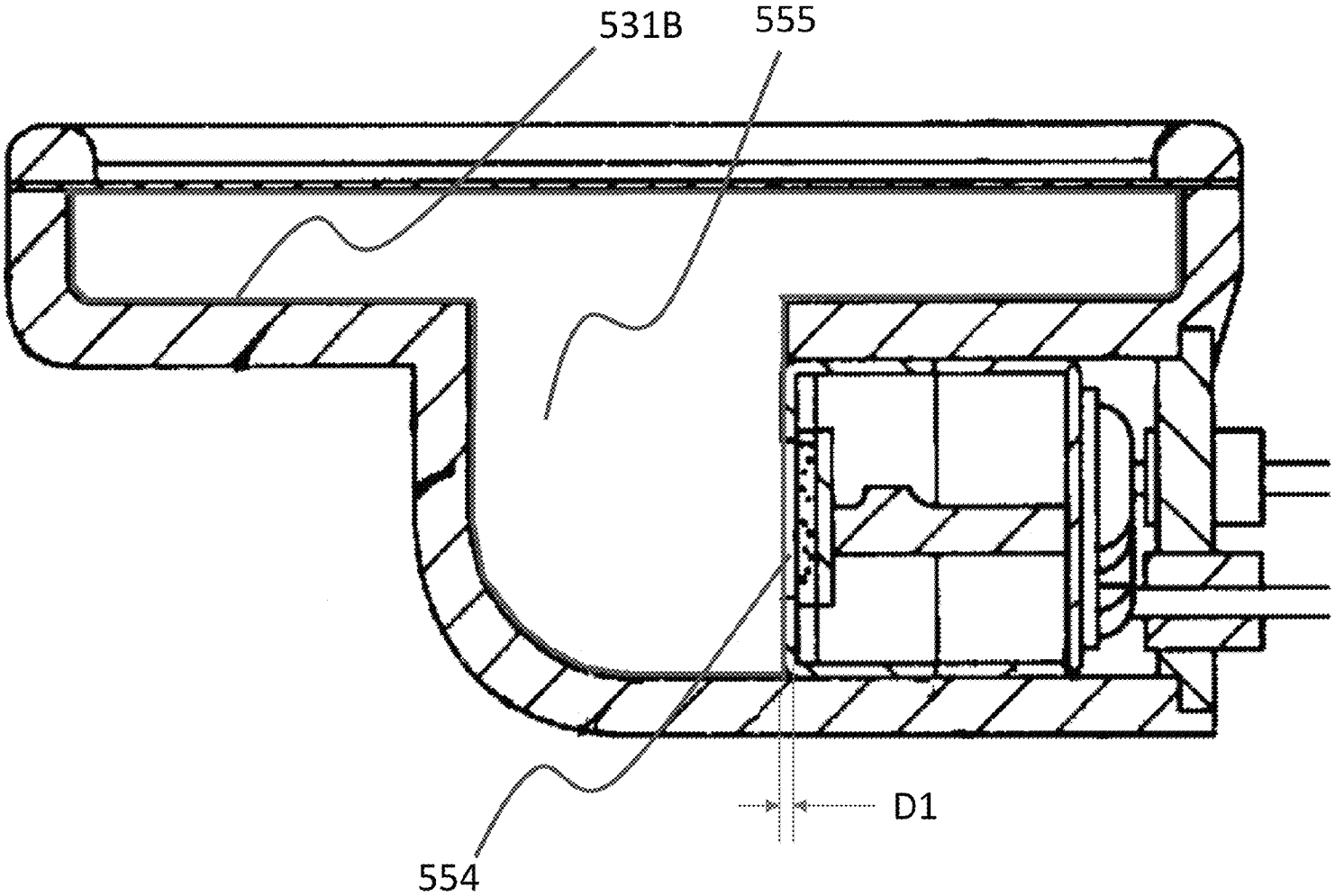
Figure 6:
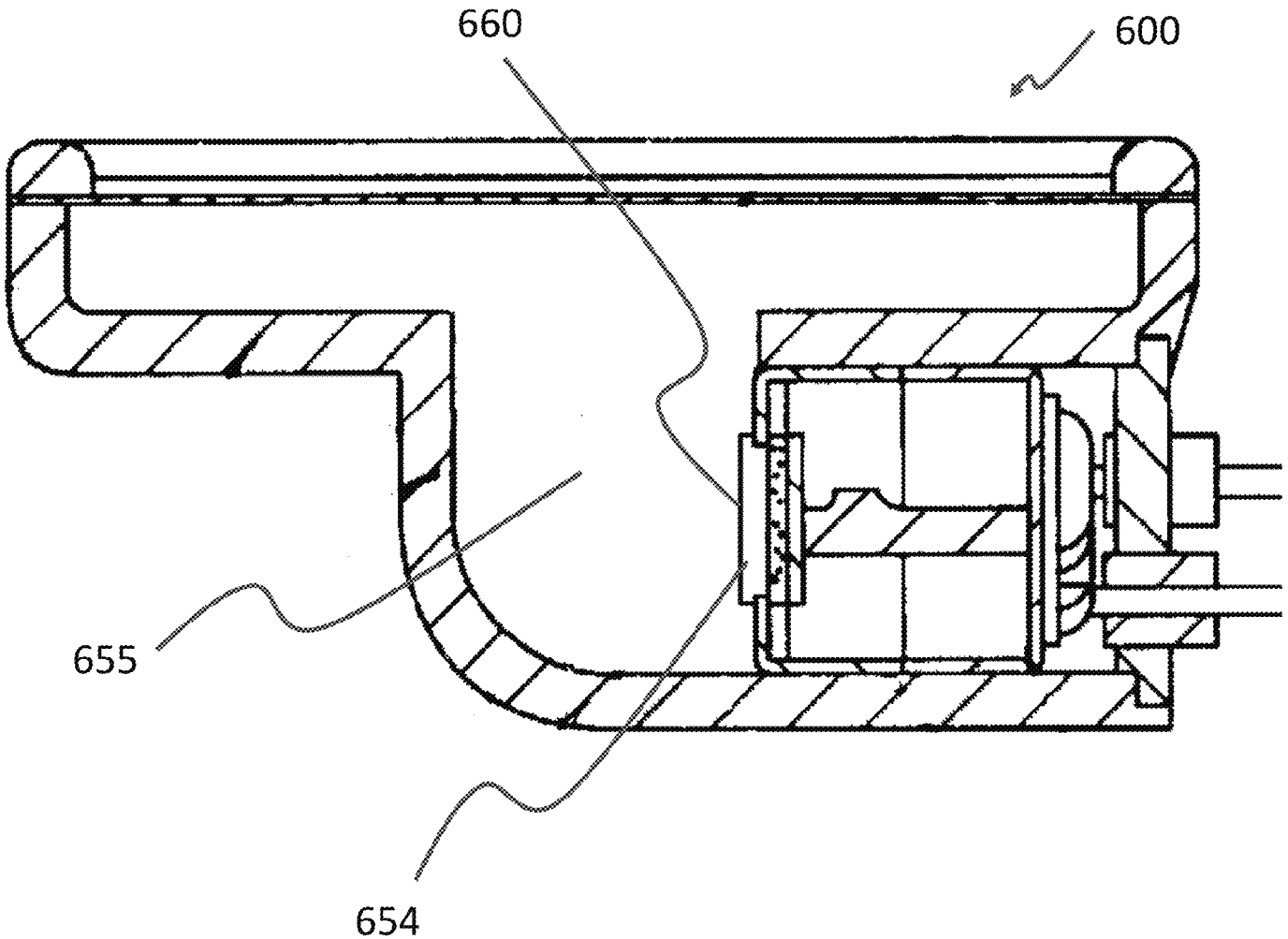
FIG. 6 depicts an exemplary view of a conceptual exemplary embodiment.

FIG. 6 depicts an exemplary embodiment of a microphone 600 corresponding to the concept of FIG. 5B, where microphone 600 corresponds to microphone 10 of FIG. 1 Specifically, microphone 600 includes a barrier apparatus 660 that prevents, or at least otherwise effectively discourages, media located to the left of the barrier 660 (e.g. such as the media detailed herein and/or variations thereof) from migrating or otherwise traveling to the right of the barrier 660 and wetting or otherwise contacting the diaphragm 54 of the microphone element 60. Some exemplary embodiments of the barrier apparatus 660 will now be described, along with some exemplary performance features thereof.

Figure 7A:
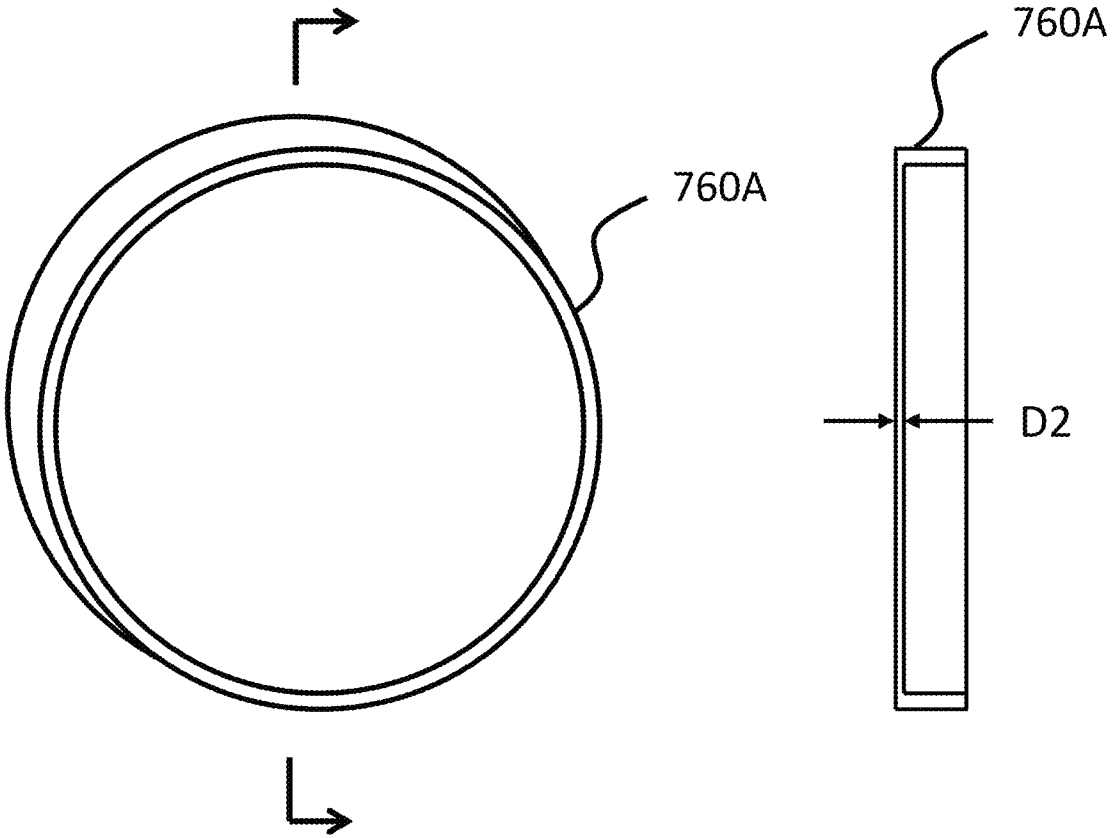
FIGS. 7A-7E depict exemplary views of exemplary embodiments corresponding to the concept of FIG. 6.

FIG. 7A depicts one exemplary embodiment of a barrier apparatus, where barrier apparatus 760A corresponds to barrier apparatus 660 of FIG. 6. In an exemplary embodiment, barrier apparatus 760 a can be considered a boot that isolates the diaphragm 54 and/or other components of the microphone element 60 from the media in the internal chamber 30. In an exemplary embodiment, barrier apparatus 760A operates on the principle of operation that the mechanical makeup (material properties and dimensions, such as a barrier apparatus having a thickness D2) of barrier apparatus 760A can enable the effective transmission of energy from the vibrations traveling through the medium within chamber 30 that impinge upon the barrier apparatus 760A to be transmitted from the left side of the apparatus to the right side of the apparatus, with respect to the frame of reference of FIG. 6, such a medium interposed between the inside of the barrier apparatus 760A and the diaphragm 54 can effectively transmit this energy to the diaphragm 54. In an exemplary embodiment, this medium can be a gas, such as argon gas. This is discussed in greater detail below. In an alternate embodiment, the medium can be a liquid having property such that the wetting of the diaphragm 54 by that liquid does not detract from the utility of the microphone element 60. Any medium that can effectively transfer the energy from the barrier apparatus 760A to the diaphragm 54 without resulting in a deleterious effect on the microphone element 60 can be utilized in at least some embodiments.

In an exemplary embodiment, a solid body or a plurality of solid bodies can be located between the barrier apparatus 760A and the diaphragm 54 that mechanically couples the two together, or at least places the barrier apparatus 760A effectively in vibrational communication with the diaphragm 54. Indeed in an exemplary embodiment, barrier apparatus 760A is a plug or the like that fits into the ports of the microphone element 60.

Figure 7B:
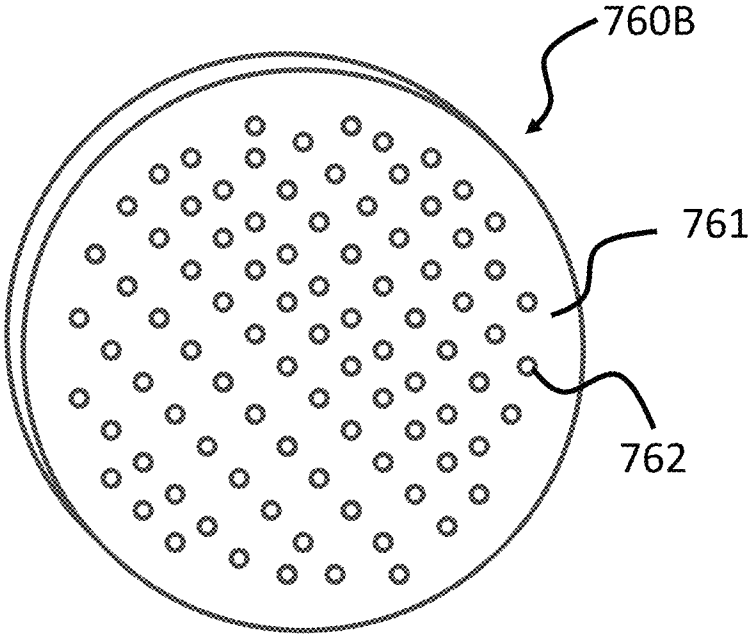

FIG. 7B depicts an alternate embodiment of a barrier apparatus, barrier apparatus 760B, that corresponds to barrier apparatus 660. Barrier apparatus 760B includes a number of through holes 762 that extend completely from one side of the barrier apparatus 760B to the other side of the barrier apparatus 760B, in a direction least substantially normal to the surface 761, although in other embodiments, the through holes can extend in different directions. A principle of operation of the barrier apparatus 760B is that the medium on the left side of the barrier apparatus is prevented from reaching the diaphragm 54 via a capillary effect. In this regard, maximum diameters of the through holes 762 on a localized plane that is normal to the direction of extension of respective through holes, and the wetting surface energy, are such that the surface tensions associated with the medium utilized with this embodiment prevents the flow of the medium into the space established between the inside of the barrier apparatus 760B and the diaphragm 54. In an exemplary embodiment, the maximum diameters are about 0.1 mm to about 1 mm, although smaller and or larger diameters can be utilized in at least some embodiments utilizing certain media, providing that the teachings detailed herein and or variations thereof can be practiced.

Figure 7C:
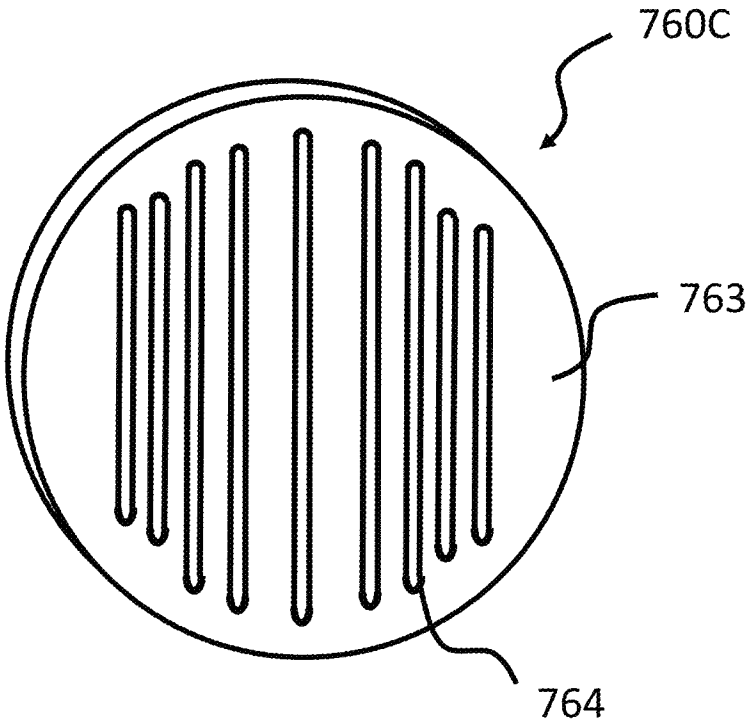

FIG. 7C depicts an alternate embodiment of a barrier apparatus, barrier apparatus 760C, that corresponds to barrier apparatus 660. Barrier apparatus 760C includes a number of through slots 764 that extend completely from one side of the barrier apparatus 760C to the other side of the barrier apparatus 760C, in a direction least substantially normal to the surface 763, although in other embodiments, the through slots can extend in different directions. A principle of operation of the barrier apparatus 760C is that the medium on the left side of the barrier apparatus (with respect to the frame of reference of FIG. 6) is prevented from reaching the diaphragm 54 via a capillary effect. In this regard, maximum dimensions of the through slots 76R on a localized plane that is normal to the direction of extension of respective through holes and normal to the lateral direction of extension of the slots is such that the surface tensions associated with the medium utilized with this embodiment prevents the flow of the medium into the space established between the inside of the barrier apparatus 760C and the diaphragm 54.

Figure 7D:
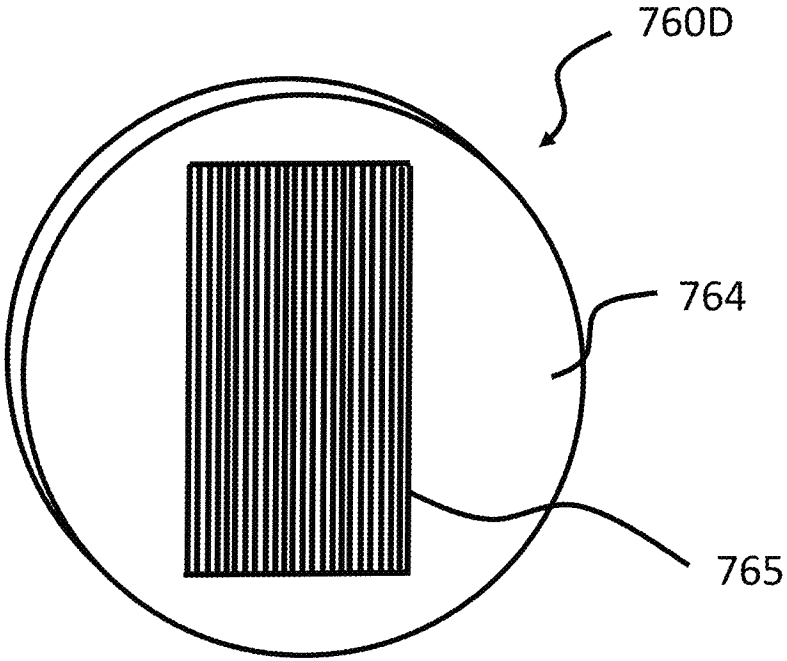

FIG. 7D depicts an alternate embodiment of a barrier apparatus, barrier apparatus 760C, that corresponds to barrier apparatus 660. Barrier apparatus 760D includes a grating 765 in surface 764 that has passages that extend completely from one side of the barrier apparatus 760C to the other side of the barrier apparatus 760C. A principle of operation of the barrier apparatus 760D is that the medium on the left side of the barrier apparatus is prevented from reaching the diaphragm 54 via a capillary effect owing to the spacing of the pattern of the grating 765. A grid can be utilized in an alternate embodiment.

With regard to the embodiments of FIGS. 7B-7D, the capillary effect effectively holds the medium, whether it be a liquid or some other fluid resistant to compression, at bay while enabling energy from the vibrations that are transmitted through the medium to be effectively transferred to the diaphragm 54 without that diaphragm being wetted by the media or otherwise deal at seriously affected by contact with the media. Accordingly, in at least some exemplary embodiments of the barrier apparatuses detailed herein and or variations thereof, the medium in the internal chamber 30 is hydrostatically held at bay by via capillary action. In this regard, in an exemplary embodiment with respect to the embodiments that utilize capillary forces, energy can be transferred from one side of the barrier apparatuses to the other side of the barrier apparatuses by upsetting the hydrostatic equilibrium, albeit in a subtle manner, such that energy from the vibrations traveling through the medium is effectively transferred from one side of the barrier apparatuses to the other side of the barrier apparatuses.

It is noted that in at least some embodiments, the barrier apparatuses detailed herein and or variations thereof are configured to keep the media filling internal chamber 30 at bay from the diaphragm 54 when the microphone is implanted in a recipient underneath the recipient skin (e.g. such as in the mastoid bone) and the recipient is exposed to about 1.1, 1.2, 1.3, 1.4, 1.5, 1.6, 1.7, 1.8, 1.9, or 2 or more atmospheres of pressure, such as might be experienced in the case of a recipient diving into a pool of water.

In at least some embodiments, the local geometry of the structure of the barrier apparatuses establishing the through passageways and/or adjacent the through passageways can be configured so as to enhance the retention of the pertinent medium with respect to the capillary forces. Alternatively and/or in addition to this, other configurations of barrier apparatuses that rely on the principle of operation of capillary effect and/or otherwise rely on surface tension of the medium to prevent or otherwise limit transfer of medium from the chamber 30 side to the diaphragm side of the barrier apparatus utilize surface properties to enhance or otherwise establish the capillary effect independent of geometry. In at least some exemplary embodiments, the barrier apparatuses can include a liquiphobic material, such as a liquiphobic coating on structure thereof or such as the structure thereof being manufactured of a liquiphobic material, at least with respect to locations proximate or otherwise forming the passages from one side of the barrier apparatuses to the other side of the barrier apparatuses. In an exemplary embodiment, the width of the material effectively enhances the restraint of liquid flowing through the passages, and thus coming into touching contact with the diaphragm 54 or other relevant components of the microphone element 60 relative to that which would be the case in the absence of the liquiphobic material.

Exemplary liquiphobic materials include hydrophobic materials and lipophobic materials, which are utilized depending on the medium in the internal chamber 30. Any type of material that can enhance her otherwise establish the capillary effects detailed herein and or variations thereof can be utilized in at least some embodiments.

In an alternate embodiment, such as by way of example and not by way of limitation, one utilizing capillary action, pertinent surfaces of the barrier apparatuses have a very strong wetting of the surface by the liquid, such that the liquid is retained on the surface of the barrier as opposed to wetting the surface of the electret of the microphone. In the former case, the liquid is prevented from penetrating the holes deeply by liquiphobic action, whereas in the latter case, the liquid is prevented from leaving the surface of the holes by liquiphillic action. A super hydrophilic surface such as titanium dioxide, with water as a working fluid, may be employed.

Figure 7E:
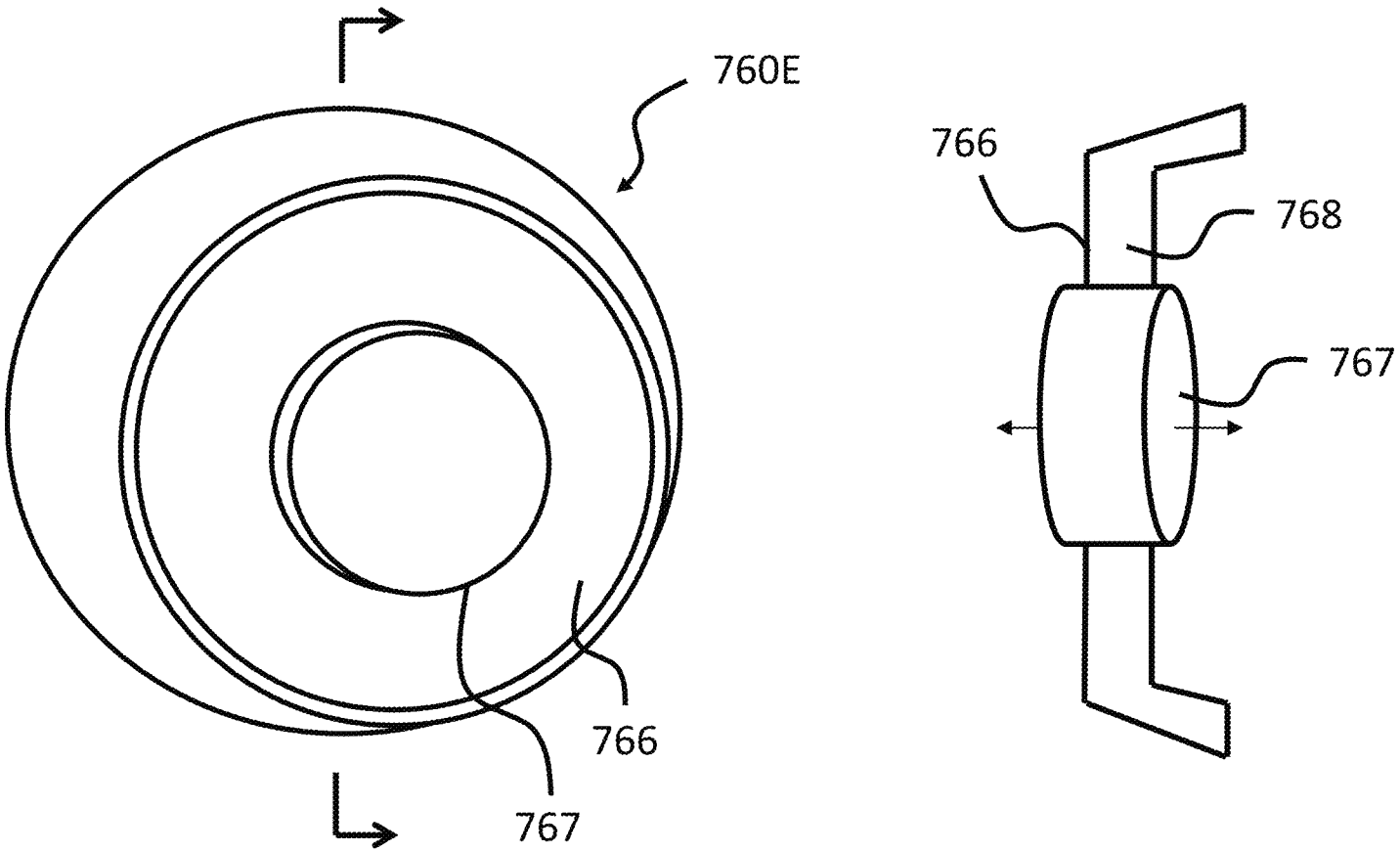

It is further noted other configurations of the barrier apparatus can be utilized that do not rely on the capillary effect. In this regard, some exemplary embodiments correspond to a deformable element positioned between the internal chamber 30 and the diaphragm 54 of the microphone elements 60. Still further, an exemplary embodiment, a piston arrangement can be utilized. Particularly, FIG. 780 depicts such an arrangement with respect to barrier apparatus 760E, which corresponds to barrier apparatus 660, where piston 767 is in slidingly-sealingly-retained relationship with wall 768 that forms surface 766. Vibrations transferred through the medium in internal chamber 30 that impinge upon the barrier apparatus 760E cause the piston to oscillate as indicated by the arrows in FIG. 7E, thereby effectively transferring energy from the chamber 30 side of the barrier apparatus 760E to the microphone element 60 side of the barrier apparatus 760E.

Any device, system and/or method that prevents or otherwise restrains the medium in the chamber 30 from coming into touching contact with the diaphragm 54 of the microphone element 60 that can enable the teachings detailed herein and or variations thereof to be practiced can be utilized in some embodiments.

At least some embodiments utilizing the barrier apparatuses detailed herein and variations thereof result in a bounded volume extending from a given barrier apparatus to the diaphragm 54 of the microphone element 60. Examples of such bounded volumes are volumes 554 and volume 654 of FIGS. 5B and 6, respectively. The bounded volumes can be established by any of the barrier apparatuses detailed herein and/or variations thereof and/or other barrier apparatuses that will enable the teachings detailed herein and or variations thereof. In an exemplary embodiment, the bounded volumes 554 and 654 can be considered local front volumes of the microphone element 60. This is as contrasted to the front of volume of the microphone established by housing 20 (e.g. the volume 555 and volume 655 of FIGS. 5B and 6, respectively). The summation of these two volumes correspond to a total front volume of the microphone system.

As noted above, the local front volumes (the bounded volumes 554 and 654, etc.) include media that effectively transmit energy impinging upon the given barrier apparatus to the microphone element 60 in general and the in particular diaphragm 54. Unlike the medium at least substantially filling the volume 555 or 655, the medium in a bounded volume 554 and/or 654 can be compressible and/or can be an ideal gas and/or can otherwise behave ideal gas at one atmosphere and at 70° F. Any gas that can interface with the microphone diaphragm 54 and permit the utilitarian use of the microphone element 60 sufficient period of time (i.e. a time period corresponding to 1, 2, 3, 4, 5 or more years of implantation in a recipient) can be utilized in some embodiments.

Thus, in an exemplary embodiment, there is an implantable microphone that includes a chamber (e.g., a chamber made up of the housing 20, the diaphragm 52 and the barrier apparatus 660—establishing volume 655). The chamber is at least substantially full (which includes full) of a mass that at least generally conforms to the boundaries of that chamber. This mass can be a liquid, a fluid that resists compression, or, in an alternate embodiment, a solid (additional details discussed below). The microphone has a transducer, such as microphone element 60. A component of the transducer, such as diaphragm 54, is in volumetric communication with the mass in the chamber. That is, a volume extends from the component to the mass. In an exemplary embodiment, the orifices, slots and/or spaces between the grates of the applicable embodiments of FIGS. 7B to 7D place the component in volumetric communication with the mass. In embodiments where the mass is a solid, the solid might be located such that there is a space between the diaphragm 54 and the solid. The microphone is configured such that the mass is restrained form coming into touching contact with the component. In an exemplary embodiment, the barrier apparatuses enable this feature, while in an alternate embodiment where the mass is a solid, the structure of the solid itself enables this feature.

In an exemplary embodiment, at least about 70%, 80%, 81%, 82%, 83%, 84%, 85%, 86%, 87%, 88%, 89%, 90%, 91%, 92%, 93%, 94%, 95%, 95.5%, 96%, 96.5%, 97%, 97.5%, 98%, 98.5%, 99%, 99.5% or about 100% or any value or range of values therebetween in 0.1% increments of the total front volume is devoid of compressible fluids.

In view of the above, in an exemplary embodiment, there is a microphone that has a total front volume having relatively little compressible matter therein. In this regard, in at least some embodiments, compressible fluids, such as ideal gases, can result in attenuation of the vibrations traveling therethrough. The amount of attenuation can be a function of the amount of compressible fluid located in the total volume. In at least some embodiments, attenuation of vibrational energy traveling through the compressible fluid is inversely proportional to the amount of compressible fluid in a given volume, all other aspects being equal. Conversely, attenuation is relatively more limited, including substantially relatively more limited, with respect to vibrational energy traveling through liquids and/or fluids resistant to compression. Accordingly, in an exemplary embodiment, by filling or at least substantially filling the total volume of the microphone and/or the volume of the microphone established by housing 20 (i.e., volume 555 and/or volume 655, etc.), with the liquids and/or compression resistant fluids, and leaving relatively little, if any, compressible matter in the total volume/segregating the compressible matter utilizing the barrier apparatuses detailed herein and or variations thereof in bounded volumes 554/654 etc., the attenuation A1 of vibrations through the total volume originating from movement of the diaphragm 52 is lower, including substantially lower, than that which would be the case (attenuation A2) if the total volume was substantially full of (including full of) a compressible gas, such as an ideal gas. In an exemplary embodiment, the attenuation ratio of A1 to A2 can be about 0.5, 0.45, 0.4, 0.35, 0.3, 0.25, 0.2, 0.15, 0.14, 0.13, 0.12, 0.11, 0.10, 0.09, 0.08, 0.07, 0.06, 0.05, 0.04, 0.03, 0.02, 0.01, or less or any value or range of values between any of these values in 0.005 increments (e.g., about 0.125, about 0.095, about 0.3 to about 0.055, etc.).

In an exemplary embodiment, by filling or at least substantially filling the total volume of the microphone and/or the volume of the microphone established by housing 20 (i.e., volume 555 and/or volume 655, etc.), with the liquids and/or compression resistant fluids, and leaving relatively little, if any, compressible matter in the total volume/segregating the compressible matter utilizing the barrier apparatuses detailed herein and or variations thereof in bounded volumes 554/654 etc., the signal to noise ratio of the microphone is reduced by about 4 dB, 4.5 dB, 5 dB, 5.5 dB, 6 dB, 6.5 dB, 7 dB, 7.5 dB, 8 dB, 8.5 dB, 9 dB, 9.5 dB 10 dB, 10.5 dB 11 dB, 11.5 dB 12 dB, 12.5 dB or more or any value or range of values therebetween in about 0.1 dB increments, relative to that which would be the case if the total volume was substantially full of including full of a compressible gas compressible gas, such as an ideal gas, all other things being equal. In an exemplary embodiment, the signal-to-noise ratio of the latter can be degraded relative to the same electret element in air by about 17 dB, and thus the signal-to-noise ratio of the microphone according to an exemplary embodiment can be improved, by way of example, 8 or 9 dB. In an exemplary embodiment, a heavy inert gas such as xenon is used to fill or at least substantially filling the total volume of the microphone and/or the volume of the microphone established by housing 20.

Conversely, some embodiments utilizing the barrier apparatuses detailed herein and variations thereof effectively result in no bounded volume extending from a given barrier apparatus to the diaphragm 54 of the microphone element 60. An example of such embodiments can correspond to, with reference to FIG. 6, a barrier apparatus 660 which extends into the volume 654 to abut or at least effectively abut diaphragm 54. Still with reference to FIG. 6, such an exemplary embodiment can correspond to a plug or the like of a gel material (e.g., a silicone gel) and/or another suitable elastomeric material (e.g., latex, rubber, Kraton (e.g., a styrenic block copolymer made up of polystyrene blocks and rubber blocks (the rubber blocks being made up of polybutadiene, polysioprene and/or their hydrogenated equivalents)) or another synthetic rubber replacement, etc.) and/or any long chain molecule composition that results in little and/or effectively no (including no) flow of the material that enables the effective transfer of vibrations traveling through the medium in internal chamber 30 impinging upon the barrier apparatus 660 to the diaphragm 54 of the microphone elements 60. It is further noted that some embodiments can correspond to the barrier apparatuses detailed above where there is a bounded volume extending from the barrier apparatus to the diaphragm, wherein the barrier apparatuses made from any one or more or all of the aforementioned materials.

Note further that in an exemplary embodiment, there are hybrid barrier apparatuses. In this regard, in an exemplary embodiment, any one of the barrier apparatuses of the embodiments of FIGS. 7A to 7E and/or variations thereof can be combined with any one or more or all of the aforementioned materials, such as by way of example and not by way of limitation, a silicone gel filling or otherwise being located in the bounded volume 654.

Some exemplary methods of manufacturing exemplary implantable microphones will now be described.

Figure 8:
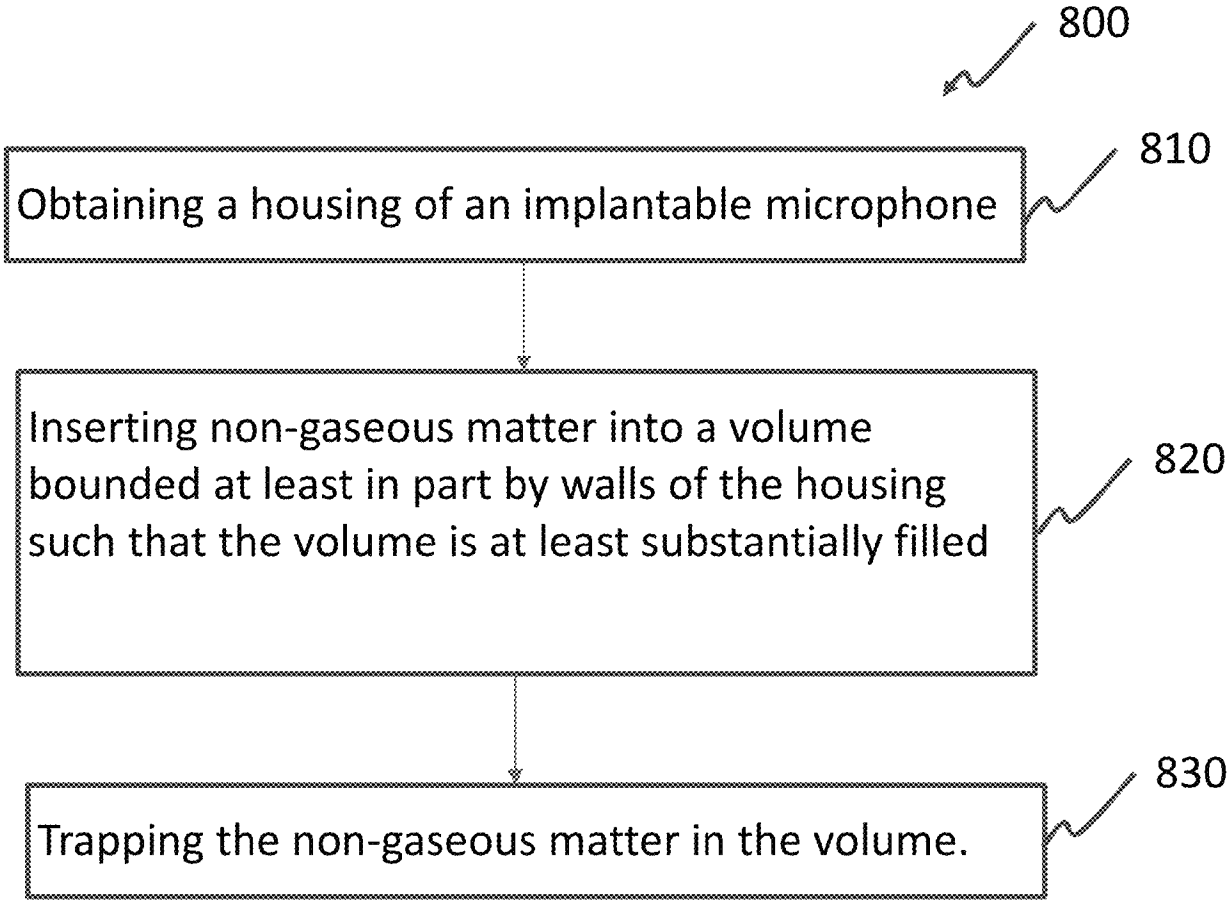
FIG. 8 presents a conceptual flow chart according to an exemplary method.

FIG. 8 presents an exemplary flow chart for a method 800 of manufacturing an exemplary implantable microphone. Method 800 includes action 810, which entails obtaining a housing of an implantable microphone, such as by way of example and not by limitation, housing 20 of FIG. 2. Method 800 further includes action 820, which entails inserting non-gaseous matter into a volume bounded at least partially by walls of the housing such that the volume is at least substantially filled. An example of such volume is volume 555 or volume 655 of FIG. 5B or 6, respectively, or, in the case where the non-gaseous matter is matter that does not wet the diaphragm 54 or otherwise effectively deleteriously present a negative impact on the performance of the diaphragm 54 over the expected implant lifetime even if it contacts the diaphragm 54, such as in the case of a solid elastomer, volume 559 of FIG. 5A.

Method 800 further includes action 830, which entails trapping the non-gaseous matter in the bounded volume. In an exemplary embodiment of method action 830, the action results in the trapped non-gaseous matter transferring vibrational energy through the volume such that a transducer, such as the microphone element 60, located proximate the volume effectively receives the transferred vibrational energy.

Figure 9:
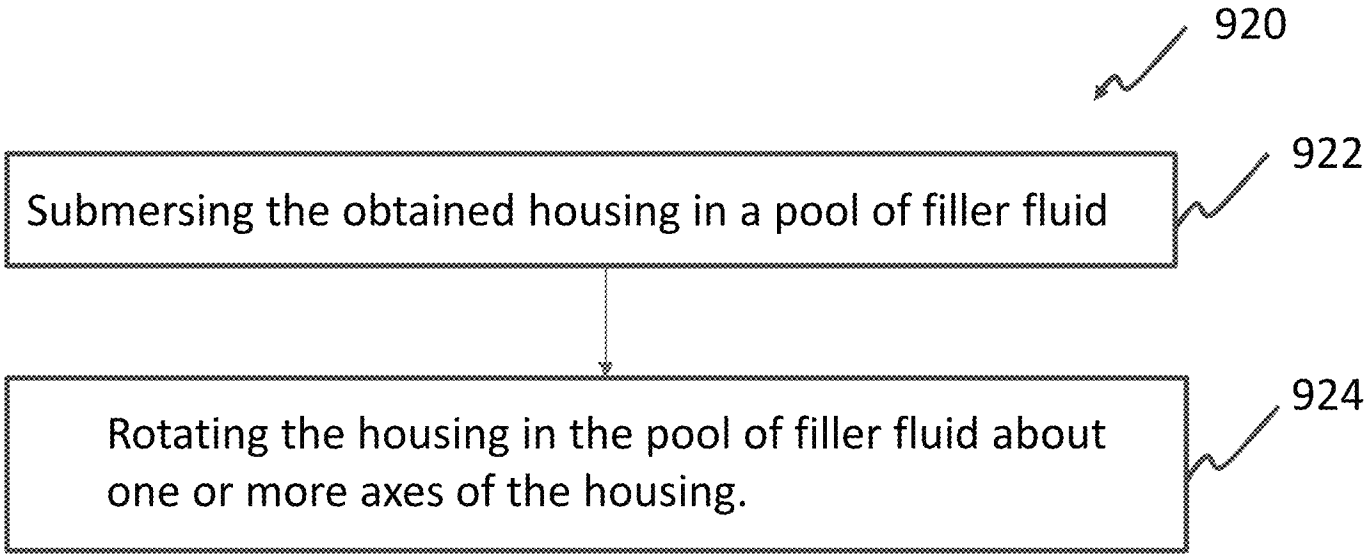
FIG. 9 presents a conceptual flow chart of an exemplary method action of the method represented in FIG. 8.

Some exemplary features of method action 820 will now be described, followed by exemplary features of method action 830 as they relate to specific details of the features of method action 820. Referring now to FIG. 9, there is presented a flowchart for a method 920 that details various exemplary actions for accomplishing method action 820. Method 920 includes method action 922, which entails submersing the obtained housing (e.g. housing 20) in a pool of filler fluid corresponding to the non-gaseous matter, which can correspond to any of the materials detailed herein and/or variations thereof, at least providing that the teachings detailed herein and/or variations thereof can be enabled and/or otherwise practice by using such matter. Method 920 further includes the action 924 of rotating the housing about one, two and/or three axes of the housing to reduce and/or effectively eliminate (which includes eliminate) any residual gas in the bounded volume. In an exemplary embodiment, the housing 20 can include an orifice that places the inside of the chamber 30 into fluid communication with an outside of the chamber 30. The housing 20 can be rotated such that the orifice is located at the highest point of the housing 20 (with respect to the direction of gravity), such that at least substantially all fluid matter within the chamber 30 (the bounded volume) that has a specific gravity lower than that of the filler fluid flows out of the chamber 30, and is replaced with the filler fluid, thereby at least substantially filling the bounded volume with the filler fluid.

It is noted that in an exemplary embodiment of method action 924, more than one orifice can be located in housing 20 that places the inside the chamber 30 into fluid communication with an outside of the chamber 30. This might be the case with respect to a housing 20 having a compound internal geometry such that fluid having a specific gravity lower than that of the filler fluid might get trapped between a portion of the housing and the orifice such that the rotations of method action 924 are not sufficient to allow effectively all of this fluid to transfer out of the chamber 30. By way of example only and not by way of limitation, with respect to FIG. 2, an orifice can be located at location 21A, 21B, and/or 21C, or any other location that will enable the teachings detailed herein and or variations thereof to be practiced.

In an exemplary embodiment, method action 830 (trapping the non-gaseous matter in the volume), entails filling the one or more orifices in the housing 20 such that the non-gaseous matter cannot leave the chamber 30 through the orifices after the volume is filled. In an exemplary embodiment, this can entail brazing and/or soldering plug(s) in the respective orifices, either while the housing 20 is submerged in the filler fluid and/or while the housing 20 is located outside the filler fluid but at an orientation such that little, if any, gas (e.g. ambient air etc.) can enter chamber 30, at least in amounts that can prevent the effective utilization of the microphone according the teachings detailed herein and or variations thereof. In an alternate embodiment, method action 830 can entail casting a material in the orifice to trap the filler fluid in the chamber/bounded volume. In an exemplary embodiment, a polymer, such as an epoxy, can be casted into the ports/orifices, such that upon curing, the polymer becomes bonded or otherwise secured to the surfaces of the port, and the filler fluid/non-gaseous matter is physically trapped inside the bounded volume. In an alternate embodiment, a fill port or the like can be threaded, and a threaded plug can be screwed into the fill port. The threads of the threaded plug and/or the threads of the fill port can be coated with a material, such as Teflon or the like, that effectively prevent fluid from seeping between the plug and the port. Alternatively and/or in addition to this, the plug and/or the filler port can be dimensioned such that the materials thereof yield upon insertion of the plug into the port, thereby establishing an effectively fluid tight seal. Alternatively and/or in addition to this, an interference fit can be utilized. Any device, system and/or method that can enable the non-gaseous fluid to be trapped inside the bounded volume for a sufficient length of time such that the microphone can be implanted into a recipient for a viable period of use can be utilized in at least some embodiments.

In an alternate embodiment, there are no orifices in the housing 20, at least orifices that are utilized specifically for filling the bounded volume with the nongaseous fluid. Instead, the existing "orifices" having functionality associated with the operation of the microphone are utilized. By way of example, method action 922 can entail submersing the housing 20 without the diaphragm 52 attached thereto and/or at least not sealingly attached thereto, such that the filler fluid flows into the internal chamber 30/bounded volume through aperture 42. Method action 830 can thus entail fixing the diaphragm 52 to the housing 20 and/or at least substantially sealing the diaphragm 52 to the housing 20 while the housing and diaphragm are submerged within the pool of filler fluid (the diaphragm 52 can be fixed to the housing after the housing is removed from the pool of filler fluid, at least in embodiments where the diaphragm 52 is sufficiently sealed to the housing 20 so as to effectively prevents ambient air or other gases from entering the chamber 30/bounded volume). It is noted that in an alternate embodiment, this can be combined with the method action entailing utilizing the orifices to fill the bounded volume.

In an alternate embodiment, the opening in the housing for the microphone element 60 is utilized to fill the bounded volume, alone and/or in conjunction with the other methods detailed herein and or variations thereof. In an exemplary embodiment, the housing 20 is submerged in the pool of filler fluid, and then the microphone element 60 is placed into the housing, where, in at least some embodiments, the housing is submerged in the pool of filler fluid. In an exemplary embodiment, at least with respect to embodiments where the barrier apparatus 660 is fixed or otherwise attached to the microphone element 60 and the barrier apparatus 660 operates on a principle of operation of capillary effect, the barrier apparatus 660, or more specifically, the passages therethrough, can be covered by a temporary cover that temporarily seals the passageways during the actions of the assembly. This temporary cover can degrade over time with exposure to the filler fluid, after the microphone element 60 is secured to the housing. Accordingly, this embodiment provides a level of security against the capillary effect being overcome due to handling of the microphone element, etc., During manufacturing.

Figure 10A:
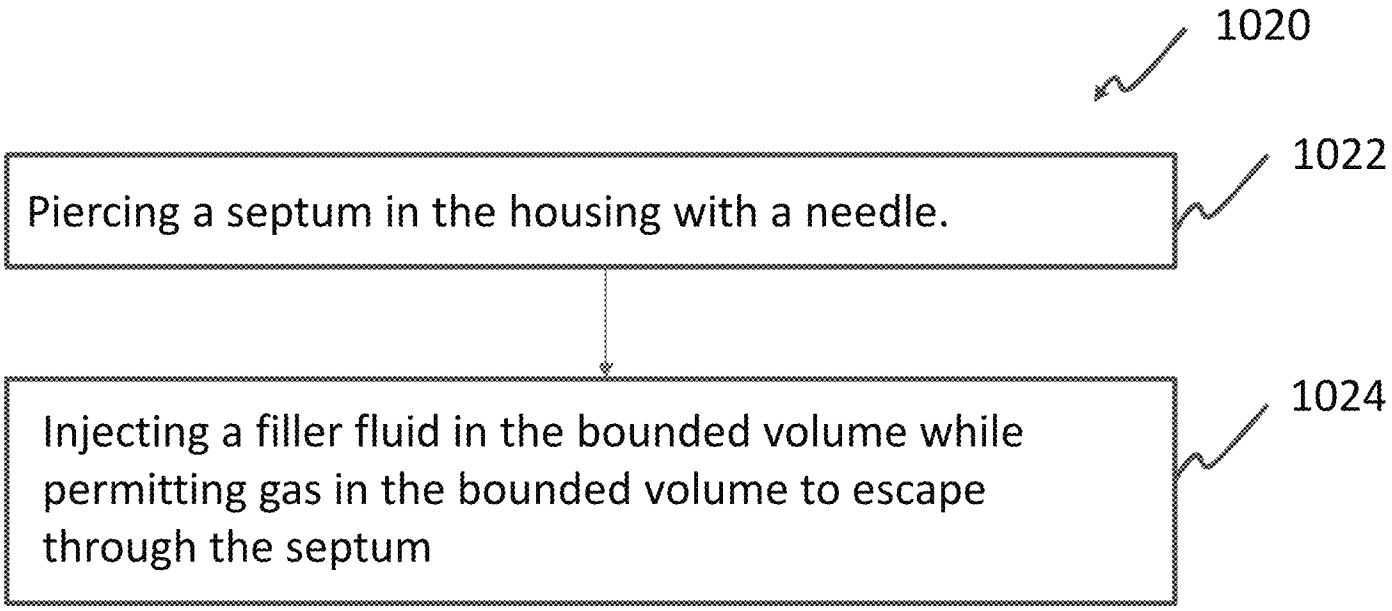
FIG. 10A presents another conceptual flow chart of another exemplary method action of the method represented in FIG. 8.
Figure 10B:
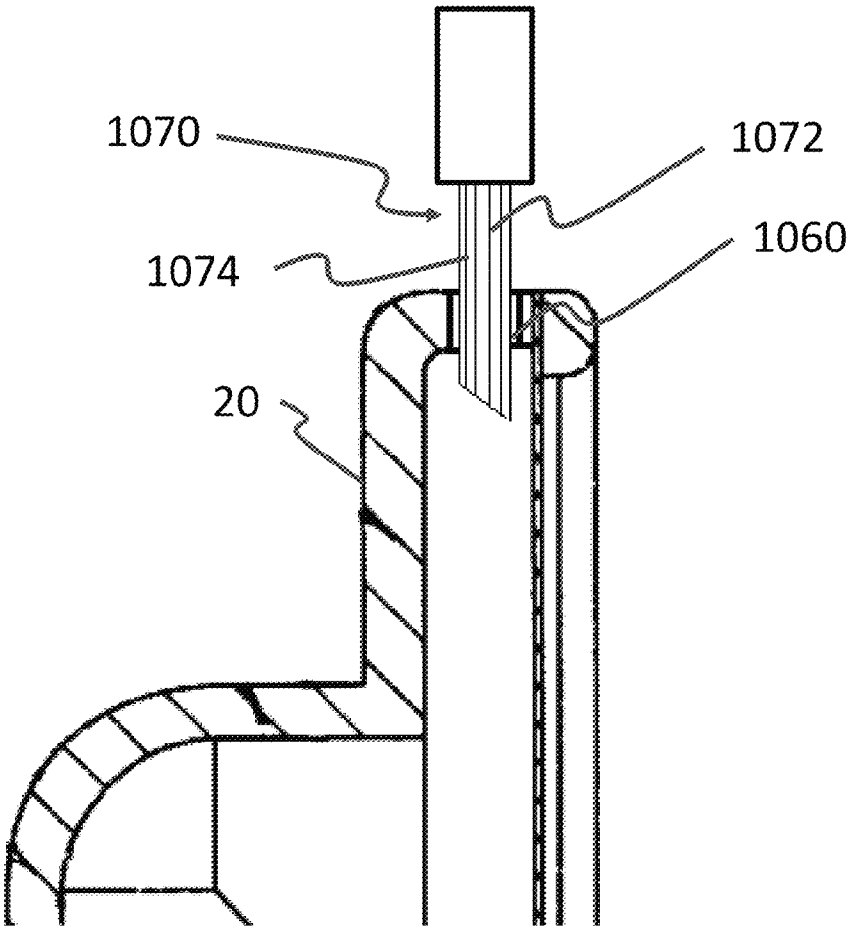
FIG. 10B present a device that can enable the method represented by FIG. 10A.

Referring now to FIG. 10A, there is a flowchart representing method 1020, which is a method of executing method action 820 of method 800. Method 1020 can be practiced utilizing the conceptual componentry of FIG. 10B, and method 1020 will be explained by way of example with respect to FIG. 10B. More specifically, FIG. 10B depicts a portion of an exemplary microphone having a housing 20 in which a septum 1060 is located. The septum 1060 is configured to be pierced by a needle 1070, as can be seen in FIG. 10B. Along these lines, method 1020 includes method action 1022, which entails piercing septum 1060 or the like in the housing 20 with a needle 1070. As can be seen from FIG. 10B, needle 1070 includes lumen 1072 and lumen 1074. In an exemplary embodiment, once needle 1070 pierces the septum 1060, such that the lumens are in fluid communication with internal chamber 30/the bounded volume, lumen 1072 is used to inject the filler fluid into the bounded volume, and lumen 1074 provides an escape route for any gases of the like located in the bounded volume that can be displaced upon the injection of filler fluid through lumen 1072. This corresponds to method action 1024 of method 1020. It is noted that in an exemplary embodiment, needle 1070 can include one or more orifices arranged about the longitudinal axis thereof that place the lateral surface of the needle 1070 into fluid communication with the lumen 1074. This can have utilitarian value in that gases located above the tip of the needle can still be forced into lumen 1074 even though the tip of the needle 1070 is located below the inner surface of the septum 1060. That is, one or more of the orifices in fluid communication with lumen 1074 can be located proximate the inner surface of the septum 1060, thus providing a route for the gas to escape the bounded volume.

In an exemplary embodiment, the action of injecting the filler fluid into the bounded volume pressurizes the bounded volume. In an alternative embodiment, the bounded volume is such that there can be another escape route for gases alike that can enable a flow rate such that the bounded volume is effectively not pressurized.

In an exemplary embodiment, septum 1060 is configured such that the septum is self-closing upon withdrawal of the needle 1070 therefrom. Therefore, in an exemplary embodiment, method action 830 is executed by withdrawing the needle 1070 from the septum 1060. In an alternate embodiment, an additional action of covering the septum with a cover to further provide is a barrier against ingress and/or egress of fluid can be utilized.

It is noted that in an alternative embodiment, two or more septa can be located in the housing 20. On septum can be used to inject the filler fluid, and the other septum can be utilize to withdrawal any gases displaced by the injection of the filler fluid. In an alternate embodiment, only one septum is provided, and the needle 1070 only has a lumen that supplies filler fluid. In such an exemplary embodiment, there can be a gas port or the like in housing 20 that allows displaced gas that is displaced from the injection of the filler fluid into the bounded volume to escape from the bounded volume.

Figure 11:
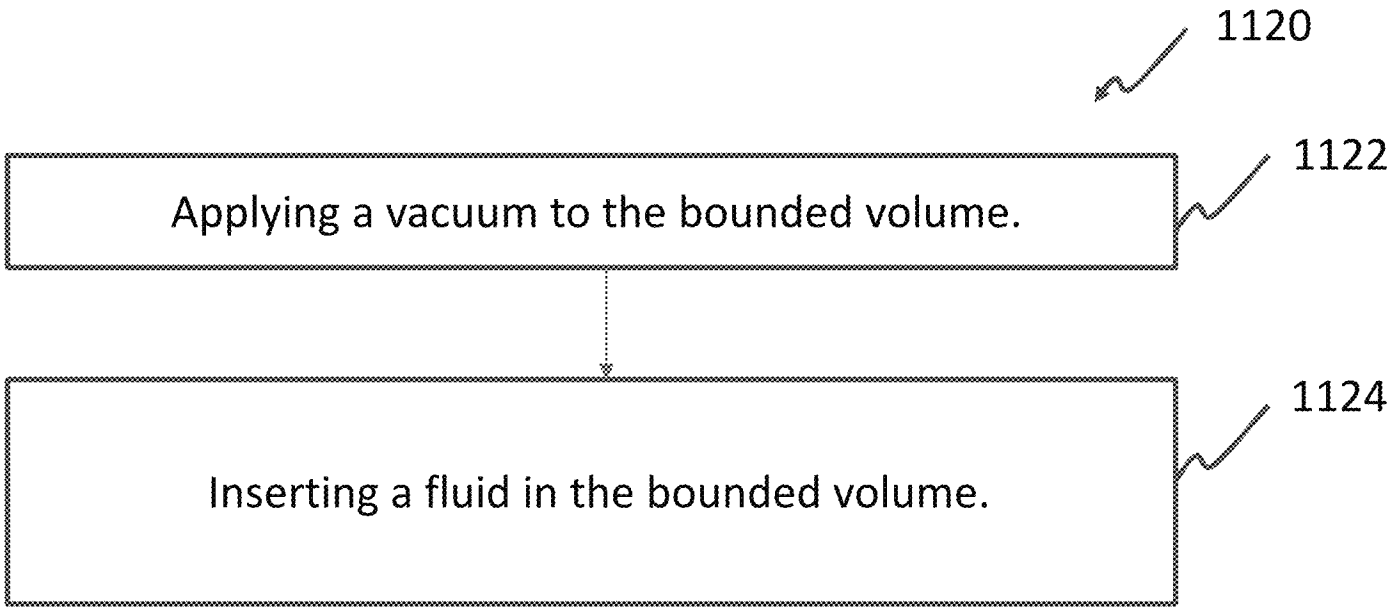
FIG. 11 presents another conceptual flow chart of another exemplary method action of the method represented in FIG. 8.

In an exemplary embodiment, at least some of the actions detailed herein associated with filling the bounded volume with the filler fluid/non-gaseous matter in detail or otherwise include a degassing phase. In in some exemplary embodiments, a vacuum is pulled or otherwise applied to the bounded volume, at least while the bounded volume is being filled by the filler fluid, thereby at least effectively removing gaseous matter therein. An exemplary embodiment, the vacuum applied to the bounded volume is such that the components of the microphone present during application of this vacuum (e.g., diaphragm 52, microphone element 60, etc.) are not damaged as a result of a pressure imbalance between the inside of the microphone (i.e. the bounded volume) and the outside of the microphone. Accordingly, FIG. 11 presents an exemplary flowchart of an exemplary method 1120 corresponding to method action 820 of method 800. Method 1120 includes method action 1122, which entails applying a vacuum to the bounded volume. In an exemplary embodiment, this applied vacuum not only withdraws gas that is located within the bounded volume, but also provides a pressure imbalance such that the non-gaseous matter is drawn into the bounded volume, although in an alternative embodiment, the non-gaseous matter can be injected into the bounded volume. Accordingly, method 1120 entails method action 1124, which corresponds to inserting a fluid in the bounded volume (which encompasses drawing a fluid into the bounded volume).

It is noted that in at least some embodiments, the method actions detailed herein and or variations thereof can be practiced in an order other than that presented and/or can be practiced simultaneously. An example of such of the method actions 1122 and 1124 of method 1120. In particular, an exemplary embodiment, method action 1122 can be practiced simultaneously with method actions 1124. An example of this is where the applied vacuum draws the fluid into the bounded volume.

In some alternative embodiments, a piston system can be utilized to execute method action 820. In an exemplary embodiment, pistons can be located in housing 20. The pistons can be movable such that movement of the pistons in a direction towards the interior of the internal chamber 30 increases the internal pressure therein/forces gas located therein out of the enclosed volume. In an exemplary embodiment, a non-gaseous matter is inserted into a fill port, such as a gel, until the bounded volume is at least substantially full of the non-gaseous matter. The pistons can then be pushed towards the inside of the internal chamber 30, thereby increasing the pressure therein and thus increasing the tendency for any gases therein to be expelled from the bounded volume. In an exemplary embodiment, these pistons can be pushed to a degree such that some of the non-gaseous matter is also pushed out of the bounded volume, thereby providing an indication that any gas trap therein has been expelled from the bounded volume.

As noted above, in at least some exemplary embodiments, the non-gaseous matter that at least substantially fills the bounded volume is a gel or the like. In at least some embodiments, the non-gaseous matter can be a solid, at least a solid having sufficient elastomeric properties or the like or otherwise having properties such that the teachings detailed herein and variations thereof associated with effective transmittal of vibrational energy originating from outside the microphone through the internal chamber 30 to the microphone element can be practiced. In this regard, in an exemplary embodiments, method action 820 entails packing the bounded volume with such a material. By way of example, the non-gaseous matter is a casting having outer dimensions that effectively correspond to the interior dimensions of the bounded volume. Accordingly, in an exemplary embodiment, there is a method that entails forming her otherwise obtaining a casting of the non-gaseous matter and placing that casting in the housing 20, followed by subsequent trapping of that casting in the housing 20. An exemplary embodiment can entail a degassing phase such that a partial vacuum is drawn such that the casted non-gaseous matter is at least substantially entirely in contact with a solid structure of the microphone 10 along substantially all of its boundaries.

It is noted that any method action detailed herein and/or variation thereof associated with filling the bounded volume can be utilized in conjunction with any other method action detailed herein and or variations thereof, providing that the bounded volume is effectively filled such that the microphone can be utilized in a utilitarian manner according to the teachings detailed herein and or variations thereof.

It is noted that any method of manufacture described herein constitutes a disclosure of the resulting product, and any description of how a device is made constitutes a disclosure of the corresponding method of manufacture. Also, it is noted that any method detailed herein constitutes a disclosure of a device to practice the method, and any functionality of a device detailed herein constitutes a method of use including that functionality.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A device, comprising:

an implantable microphone, including: a chamber in which one or more mediums corresponding to at least one of a liquid or a gel is located such that vibrations originating external to the microphone are effectively transmitted through the media, wherein the chamber forms a bounded volume extending from a first component that moves in response to the vibrations originating from exterior to the microphone to a location at least proximate a second component that moves in response to the vibrations, wherein portions of the implantable microphone establishing the bounded volume between the first and second component are static portions, wherein the vibrations originating external to the microphone are acoustic signals impinging upon skin of the recipient resulting from, with respect to a recipient of the implantable microphone, ambient noise, and thus the first component and the second component move in response to acoustic signals originating from ambient noise with respect to the recipient.

2. The device of claim 1, wherein the chamber is full of a liquid.

3. The device of claim 1, wherein the chamber is full of a gel.

4. The device of claim 1, wherein: the chamber is bounded by a housing and at least one diaphragm that forms a barrier between an ambient environment of the implantable microphone and the chamber, wherein a majority of the surface area of the chamber is established by the housing.

5. The device of claim 1, wherein:

the chamber is established by structure consisting of housing walls and two diaphragms.

6. The device of claim 1, further comprising:

a transducer in effective vibration communication with the media, wherein the transducer is configured to convert vibration travelling through the media to an electrical signal, and wherein the transducer is fixed relative to a housing forming part of the chamber.

7. The device of claim 1, wherein:

at least one diaphragm forms a boundary of the chamber, all diaphragms forming a boundary of the chamber respectively have contiguously closed surfaces.

8. The device of claim 1, further comprising:

a transducer in effective vibration communication with the media, wherein the transducer is configured to convert vibration travelling through the media to an electrical signal, and wherein the implantable microphone is configured such that the electrical signal is based on all forces acting on the microphone.

9. The device of claim 1, wherein:

the chamber is bounded by a first diaphragm and a second diaphragm and no other diaphragms.

10. The device of claim 1, wherein:

at least one diaphragm forms a boundary of the chamber, all diaphragms in fluid communication with the chamber prevent the at least one of the liquid or the fluid from extending beyond a first side of the respective diaphragm to a second side of the respective diaphragm.

11. The device of claim 1, wherein at least one of:

the chamber is established in part by the two diaphragms respectively corresponding to the first component and the second component, one of the two diaphragms being angled relative to the other of the two diaphragms; or the transducer is fixed relative to a housing forming part of the chamber.

12. The device of claim 1, wherein:

the gel is resistant to compression.

13. A device, comprising:

an implantable microphone, including:

a chamber in which one or more mediums corresponding to at least one of a liquid or a gel is located such that vibrations originating external to the microphone are effectively transmitted through the media; and a transducer in effective vibration communication with the media, wherein the transducer is configured to convert vibration travelling through the media to an electrical signal, wherein:

the chamber is established in part by two diaphragms, one of the two diaphragms being angled relative to the other of the two diaphragms.

14. The device of claim 13, wherein: the media is a liquid; and transducer is a hydrophone.

15. The device of claim 13, wherein: the transducer is a electret transducer.

16. The device of claim 13, wherein:

the chamber forms a bounded volume extending from a first of the two diaphragms that moves in response to the vibrations originating from exterior to the microphone to a location at least proximate a second of the two diaphragms that moves in response to the vibrations, wherein portions of the implantable microphone establishing the bounded volume between the first and second diaphragms are static-portions.

17. The device of claim 16, wherein:

the chamber is established in part by the two diaphragms, one of the two diaphragms being angled relative to the other of the two diaphragms.

18. The device of claim 16, wherein:

the transducer is fixed relative to the housing forming part of the chamber.

19. The device of claim 13, wherein:

the chamber is established in part by the two diaphragms, one of the two diaphragms being angled relative to the other of the two diaphragms.

20. The device of claim 13, wherein:

the transducer is fixed relative to the housing forming part of the chamber.

21. The device of claim 13, wherein:

the gel is resistant to compression.

22. A device, comprising: an implantable microphone, including: a chamber in which one or more mediums corresponding to at least one of a liquid, oil, saline solution, gel, oil, water or alcohol is located such that vibrations originating external to the microphone are effectively transmitted through the media; and an electret transducer having a back volume, wherein the chamber forms a bounded volume extending from a component that moves in response to the vibrations originating from exterior to the microphone to a location at least proximate the transducer, wherein the bounded volume has a volume of at least about one-half that of a back volume of the transducer, and physical attenuation of energy traveling through the bounded volume, resulting from vibrations impinging upon the component that moves, that is transduced by the transducer, is less than about three dB.

23. The device of claim 22, wherein:

the chamber at least substantially full of a mass at least generally conforming to boundaries thereof, the implantable microphone includes a transducer having a first component in volumetric communication with the mass, and the implantable microphone is configured such that the mass is restrained from coming into touching contacting with the first component.

* * * * *